US008568951B2

(12) United States Patent
Watanabe et al.

(10) Patent No.: US 8,568,951 B2
(45) Date of Patent: Oct. 29, 2013

(54) TONER, METHOD OF MANUFACTURING TONER, IMAGE FORMING METHOD, IMAGE FORMING APPARATUS, AND PROCESS CARTRIDGE

(75) Inventors: Masaki Watanabe, Shizuoka (JP); Hiroshi Yamashita, Shizuoka (JP); Satoyuki Sekiguchi, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 28 days.

(21) Appl. No.: 13/414,151

(22) Filed: Mar. 7, 2012

(65) Prior Publication Data

US 2012/0237870 A1 Sep. 20, 2012

(30) Foreign Application Priority Data

Mar. 16, 2011 (JP) ..... 2011-058611
Dec. 27, 2011 (JP) ..... 2011-285039

(51) Int. Cl.
*G03G 9/093* (2006.01)

(52) U.S. Cl.
USPC ..... 430/110.2; 430/110.1; 430/109.3; 430/109.4

(58) Field of Classification Search
USPC ..... 430/110.2, 110.1, 109.3, 109.4
See application file for complete search history.

(56) References Cited

U.S. PATENT DOCUMENTS

2010/0061767 A1 * 3/2010 Kawase et al. ..... 399/252

FOREIGN PATENT DOCUMENTS

| | | |
|---|---|---|
| JP | 5-40366 | 2/1993 |
| JP | 6-250439 | 9/1994 |
| JP | 7-209952 | 8/1995 |
| JP | 2000-75551 | 3/2000 |
| JP | 2000-321812 | 11/2000 |
| JP | 2001-66820 | 3/2001 |
| JP | 2002-14487 | 1/2002 |
| JP | 2003-140381 | 5/2003 |
| JP | 2008-304657 | 12/2008 |
| JP | 2009-109661 | 5/2009 |
| JP | 2010-72033 | 4/2010 |

* cited by examiner

*Primary Examiner* — Hoa V Le
(74) *Attorney, Agent, or Firm* — Oblon, Spivak, McClelland, Maier & Neustadt, L.L.P.

(57) ABSTRACT

A toner including a main body particle, a layer B located overlying the main body particle, and a layer A located overlying the layer B is provided. The binder resin includes an amorphous resin and a crystalline resin. The layer B is comprised of particles of a resin B. The layer A is comprised of particles of a resin A. A method of manufacturing the above toner is also provided. The method includes dissolving or dispersing toner components in an organic solvent to prepare a toner components liquid. The toner components include the binder resin. The method further includes emulsifying the toner components liquid in an aqueous medium to prepare an emulsion. The aqueous medium contains the particles of the resins A and B. The method further includes removing the organic solvent from the emulsion and heating the emulsion.

11 Claims, 3 Drawing Sheets

TONER, METHOD OF MANUFACTURING TONER, IMAGE FORMING METHOD, IMAGE FORMING APPARATUS, AND PROCESS CARTRIDGE

CROSS-REFERENCE TO RELATED APPLICATIONS

This patent application is based on and claims priority pursuant to 35 U.S.C. §119 to Japanese Patent Application Nos. 2011-058611 and 2011-285039, filed on Mar. 16, 2011 and Dec. 27, 2011, respectively, in the Japanese Patent Office, the entire disclosure of each of which is hereby incorporated herein by reference.

BACKGROUND

1. Technical Field

The present disclosure relates to a toner, a method of manufacturing toner, an image forming method, an image forming apparatus, and a process cartridge.

2. Description of Related Art

Recently, various high-speed and high-quality full-color image forming technologies have been developed in electrophotography. Japanese Patent Application Publication Nos. 07-209952 and 2000-075551 each describe a tandem image forming apparatus employing an intermediate transfer method. The apparatus includes tandemly-arranged multiple electrophotographic photoreceptors each adapted to form single-color toner image and an intermediate transfer member onto which the single-color toner images are transferred from the multiple electrophotographic photoreceptors. Intermediate transfer methods are advantageous in preventing the occurrence of background fouling but disadvantageous in terms of transfer efficiency because of including two transfer processes, i.e., the primary transfer process in which toner images are transferred from electrophotographic photoreceptors onto an intermediate transfer member and the secondary transfer process in which the toner images are further transferred from the intermediate transfer member onto a recording medium.

To meet demand for high-quality image, toners have been developed to have a much smaller particle size to more precisely reproduce latent images. Japanese Patent No. 3640918 and Japanese Patent Application Publication No. 06-250439 each describe a polymerization method for manufacturing toner. It is described therein that the polymerization method is capable of control particle size and shape of toner. It is also described therein that small-sized toner particles can precisely reproduce dots and thin lines with smaller pile height (i.e., image thickness).

Generally, in electrophotography, as the size of a toner particle gets smaller, non-electrostatic adhesive force between the toner particle and a photoreceptor or an intermediate transfer member gets larger, which results in poor transfer efficiency. Therefore, when small-sized toner particles are used in a high-speed full-color image forming apparatus, the secondary transfer efficiency may drastically decrease. The reason is not only that the non-electrostatic adhesive force between a toner particle and an intermediate transfer member is increased but also that a time period within which toner particles, in a multilayer, are exposed to the secondary transfer electric field is shortened in the high-speed apparatus, as the size of the toner particle gets smaller.

One approach for improving transfer efficiency includes increasing the secondary transfer electric field, but this approach not always improves transfer efficiency. Another approach for improving transfer efficiency includes increasing the width of the secondary transfer nip so that toner particles can be exposed to the secondary transfer electric field much longer. In a case in which a contact bias roller is employed in the secondary transfer, the contacting pressure or diameter of the bias roller may be increased to increase the width of the secondary transfer nip, each of which is not preferable in terms of image quality and compactness. In a case in which a non-contact charger is employed in the secondary transfer, the number of chargers may be increased to increase the width of the secondary transfer nip, which is not preferable in terms of compactness and cost.

Japanese Patent Application Publication No. 2001-066820 and Japanese Patent No. 3692829 each propose a technique for adjusting the kinds and amounts of external additives of toner. It is described therein that non-electrostatic adhesive force between a toner particle and a photoreceptor or an intermediate transfer member is reduced by adjusting the kinds and amounts of external additives.

However, the external additives may be gradually buried in toner particles as the toner particles receive mechanical stress due to agitation in a developing device. As a result, the external additives may no more function and transfer efficiency may deteriorate. This phenomenon notably occurs in high-speed apparatuses because agitation in developing device is more intensive.

One approach for providing high transfer efficiency for an extended period of time even in high-speed apparatuses involves controlling mechanical strength of the surfaces of toner particles so that external additives are not buried in the toner particles even under exposure to mechanical stress. The toner manufacturing method described in Japanese Patent No. 3640918 has attempted to form a thick layer of resin particles on the surfaces of toner particles to increase mechanical strength of the toner particles. Toner particles having too stiff surface cannot melt well when fused on a recording medium upon application of heat. In a case in which toner particles include a release agent such as wax, the release agent cannot exude from the toner particles when fused on a recording medium upon application of heat.

SUMMARY

In accordance with some embodiments, a toner including a main body particle, a layer B located overlying the main body particle, and a layer A located overlying the layer B is provided. The binder resin includes an amorphous resin and a crystalline resin. The layer B is comprised of particles of a resin B. The layer A is comprised of particles of a resin A.

In accordance with some embodiments, a method of manufacturing the above toner is provided. The method includes dissolving or dispersing toner components in an organic solvent to prepare a toner components liquid. The toner components include the binder resin. The method further includes emulsifying the toner components liquid in an aqueous medium to prepare an emulsion. The aqueous medium contains the particles of the resins A and B. The method further includes removing the organic solvent from the emulsion and heating the emulsion.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
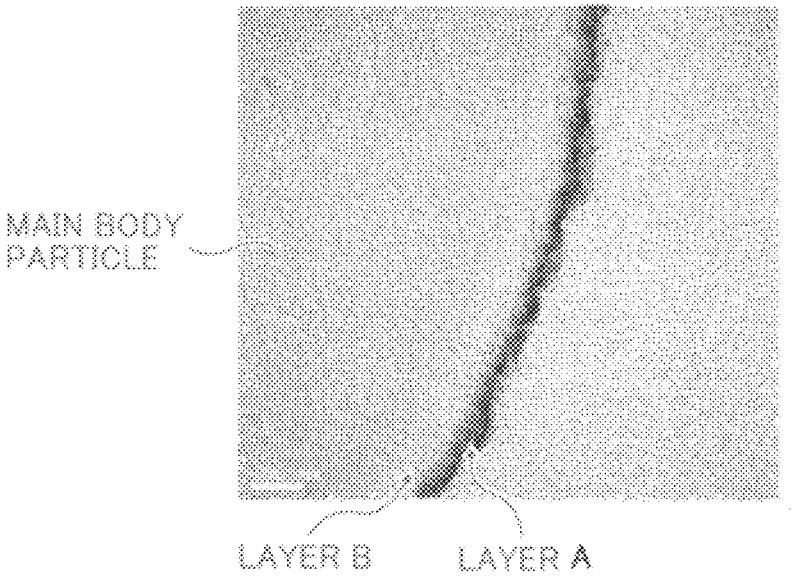
FIG. 1 is a photograph of a surface area of a toner according to an embodiment.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For the sake of simplicity, the same reference number will be given to identical constituent elements such as parts and materials having the same functions and redundant descriptions thereof omitted unless otherwise stated.

A toner according to an embodiment includes a main body particle, a layer B located overlying the main body particle, and a layer A located overlying the layer B. The binder resin includes an amorphous resin and a crystalline resin. The layer B is comprised of particles of a resin B. The layer A is comprised of particles of a resin A.

The toner according to an embodiment may be granulated in an aqueous medium. In some embodiments, the toner is produced by dissolving or dispersing toner components including the binder resin or a precursor thereof in an organic solvent to prepare a toner components liquid, emulsifying the toner components liquid in an aqueous medium containing particles of the resin A to prepare an emulsion, removing the organic solvent from the emulsion to form toner particles, dispersing the toner particles in ion-exchange water to prepare a dispersion, and heating and agitating the dispersion. In the process of emulsifying the toner components liquid in an aqueous medium, particles of the resin B are added to the aqueous medium. More specifically, the particles of the resin B is added to the aqueous medium either before or after the particles of the resin A and an anionic surfactant (to be described later) are added to the aqueous medium, either before or after the toner components liquid is added to the aqueous medium, during the occurrence of an emulsification by agitation, or after termination of the emulsification. In either case, liquid droplets of the toner components liquid contain the organic solvent. The particles of the resin B adhere to the surfaces of the liquid droplets while slightly intrude therein and fix on the main body particle of the toner upon removal of the organic solvent.

The particles of the resin A are adapted to reliably disperse liquid droplets of the toner components liquid in the aqueous medium and to form the layer A outside the main body particle. The particles of the resin B are adapted to form the layer B between the main body particle and the layer A comprising the particles of the resin A. The binder resin is incompatible with the resin B.

In some embodiments, the resin A is a styrene-acrylic resin, the resin B is an acrylic resin, and the binder resin includes a polyester resin, a polyol resin, and/or a polyurethane resin. In some embodiments, the binder resin includes a styrene-acrylic resin and each of the resins A and B is independently selected from an acrylic resin, a polyester resin, a polyol resin, and a polyurethane resin, while the resins A and B being different from each other. In some embodiments, the binder resin includes a polyester resin and each of the resins A and B is independently selected from a styrene-acrylic resin, an acrylic resin, a polycarbonate resin, an ABS resin, and an SBR resin, while the resins A and B being different from each other.

In some embodiments, the acid value of the resin A is higher than that of the resin B, which is advantageous in terms of the ease of granulation process.

In some embodiments, the binder resin includes a polyester resin, which is advantageous in terms of low-temperature fixability. In some embodiments, the resin A is a styrene-acrylic resin and the resin B is an acrylic resin, which is advantageous in terms of transfer efficiency because both of which are relatively stiff or hard.

FIG. 1 is a photograph of a surface area of a toner according to an embodiment. In this embodiment, particles of an acrylic resin (i.e., resin B) are adhered to the surface of the main body particle forming the layer B and particles of a styrene-acrylic resin (i.e., resin A) are adhered to the layer B forming the layer A.

Generally, in electrophotography, non-electrostatic adhesive force between a toner particle and a photoreceptor or an intermediate transfer member gets larger as the particle size of the toner particle gets smaller, resulting in poor transfer efficiency. Additionally, in high-speed image formation, a time period within which a toner particle is exposed to a transfer electric field, in particular the secondary transfer electric field, gets shorter as the particle size of the toner particle gets smaller, resulting in poor secondary transfer efficiency. On the other hand, non-electrostatic adhesive force between the toner particle according to an embodiment and an intermediate transfer member is small because the particles of the resins A and B function as spacers. Therefore, the toner according to an embodiment provides high transfer efficiency even when the transfer time period is short. The particles of the resins A and B are prevented from being buried in the main body particle due to their high stiffness or hardness even when the toner is exposed to mechanical stress. Thus, the toner according to an embodiment provides high transfer efficiency for an extended period of time. External additives adhered to the surface of the toner are also prevented from being buried in the toner due to high stiffness or hardness of the resins A and B.

The particles of the resin A, such as a styrene-acrylic resin, melt and coalesce to form the layer A having a relatively high hardness. The layer A prevents the particles of the resin B, such as an acrylic resin, from being buried in the main body particle even when the toner is exposed to mechanical stress. In some embodiments, the binder resin includes a polyester resin and the resin A employs an anionic styrene-acrylic resin. In such embodiments, particles of the anionic styrene-acrylic resin reliably adhere to liquid droplets of the toner components liquid including the polyester resin while suppressing coalescence of the liquid droplets. As a result, toner particles having a narrow particle diameter distribution are provided. The anionic styrene-acrylic resin gives negative charge to the toner. In some embodiments, the particles of the anionic styrene-acrylic resin have an average particle diameter of 5 to 50 nm.

In some embodiments, the toner has a weight average particle diameter of 1 to 10 μm or 4 to 6 μm. When the weight average particle diameter is less than 1 μm, the toner particles are likely to scatter in the primary and secondary transfer processes. When the weight average particle diameter is greater than 10 μm, dot reproducibility and halftone granularity are so poor that high-definition image is not produced.

In some embodiments, the particles of the resin B, such as an acrylic resin, have a primary average particle diameter of 10 to 500 nm or 100 to 400 nm. In such embodiments, the toner has a lower non-electrostatic adhesive force due to spacer effect of the particles of the resin B. The particles of the resin B are prevented from being buried in the main body particle even when the toner is exposed to mechanical stress, thus preventing increase of the non-electrostatic adhesive force and providing high transfer efficiency for an extended period of time. The toner can be used for an image forming process having a primary transfer process and a secondary transfer process. In particular, the toner can be used for an image forming process in which the transfer linear speed is from 300 to 1,000 mm/sec and the secondary transfer time period is 0.5 to 20 msec.

When the primary average particle diameter of the resin B is less than 10 nm, the toner may not have a lower non-electrostatic adhesive force because spacer effect of the particles of the resin B is insufficient. The particles of the resin B may be easily buried in the main body particle when the toner is exposed to mechanical stress. Thus, high transfer efficiency cannot be provided for an extended period of time. When the primary average particle diameter of the resin B is greater than 500 nm, the toner cannot be uniformly transferred due to its low fluidity.

Generally, it is likely that resin particles present on the surfaces of toner particles are buried therein or get into concave portions thereon when the toner particles are exposed to mechanical stress in, for example, a developing device. As a result, the toner particles increase their adhesive force. Similarly, it is likely that external additives present on the surfaces of toner particles are buried therein when the toner particles are exposed to mechanical stress. As a result, the toner particles increase their adhesive force.

In some embodiments, the acrylic resin as the resin B is a cross-linked resin. The particles of such a cross-linked acrylic resin, having a relatively high hardness, provide good spacer effect without being deformed even when exposed to mechanical stress and also prevent external additives from being buried in the toner particles. As a result, the toner particles are prevented from decreasing their adhesive force.

In some embodiments, the binder resin includes a polyester resin. The binder resin is incompatible with the resin B. Therefore, in these embodiments, the polyester resin is incompatible with particles of the resin B such as an acrylic resin. In a case in which particles of an acrylic resin as the resin B are added to the aqueous medium before or after the emulsification, the particles of the acrylic resin may adhere to and then dissolve in liquid droplets of the toner components liquid because the liquid droplets contain the organic solvent. When the binder resin includes a polyester resin, the particles of the acrylic resin may only adhere to liquid droplets, without dissolving therein, because the acrylic and polyester resins are poorly compatible with each other. The particles of the acrylic resin adhere to the surfaces of the liquid droplets while slightly intrude therein and fix thereon upon removal of the organic solvent. Whether two resins are compatible with each other or not can be determined as follows. Dissolve 50% by weight of each resin in an organic solvent. Mix the resulting two resin solutions. When the mixture solution is observed to be separated into two layers, the two resins are regarded as being incompatible. When the mixture solution is observed not to be separated into two layers, the two resins are regarded as being compatible.

In some embodiments, the aqueous medium contains an anionic surfactant and the resin B is an acrylic resin capable of aggregating in the aqueous medium containing the anionic surfactant. In such embodiments, each of the particles of the acrylic resin is prevented from being stably and independently dispersed in the aqueous medium without being adhered to liquid droplets of the toner components liquid in the process of emulsification. The particles of the acrylic resin, capable of aggregating in the aqueous medium containing the anionic surfactant, are easily adhered to liquid droplets of the toner components liquid in the process of emulsification. This is because the particles of the acrylic resin cannot be stably dispersed in the aqueous medium containing the anionic surfactant, and therefore they are attracted to liquid droplets of the toner components liquid without self-aggregating.

Specific examples of usable anionic surfactants include, but are not limited to, fatty acid salts, alkyl sulfates, alkyl aryl sulfonates, alkyl diaryl ether disulfonates, dialkyl sulfosuccinates, alkyl phosphates, naphthalenesulfonic acid formalin condensates, polyoxyethylene alkyl phosphates, and glyceryl borate fatty acid esters.

After the emulsification, the particles of the acrylic resin may be more strongly fixed on the surfaces of the liquid droplets by being heated to above the glass transition temperature thereof.

In some embodiments, the toner components include a compound having an active hydrogen group and a modified polyester resin reactive with the compound, both as precursors of the binder resin. In such embodiments, the resulting toner particles have better mechanical strength enough for preventing particles of the resin B or external additives from being buried in the toner particles. When the compound having an active hydrogen group is cationic, particles of an acrylic resin as the resin B are electrostatically attracted thereto. Also, it is possible to control fusibility upon application of heat to widen fixable temperature range of the toner.

In some embodiments, the content of the resin B in the toner is 0.5 to 5% by weight or 1 to 4% by weight based on total weight of the toner. When the content of the resin B is less than 0.5% by weight, the toner may not have a lower non-electrostatic adhesive force because spacer effect of the particles of the resin B is insufficient. When the content of the resin B is greater than 5% by weight, the toner may not be uniformly transferred due to its poor fluidity. Also, the particles may be weakly fixed on the toner and therefore contaminate carrier particles and photoreceptor.

In some embodiments, the toner has an average circularity of 0.950 to 0.990. When the average circularity is less than 0.950, developability and transferability of the toner may be poor.

In some embodiments, the ratio (Dw/Dn) of the weight average particle diameter (Dw) to the number average particle diameter (Dn) of the toner is 1.30 or less, 1.00 to 1.30, or 1.15 or less. When Dw/Dn is greater than 1.30, it may be difficult to produce high-resolution and high-quality images. Moreover, the average particle diameter of such toner particles in a developer may largely vary upon consumption and supply of the toner particles.

When Dw/Dn is 1.00 to 1.30, the toner has a good combination of storage stability, low-temperature fixability, hot offset resistance, and gloss property. When such a toner is used for a two-component developer, the average toner size may not vary very much although consumption and supply of toner particles are repeated. When such a toner is used for a one-component developer, the average toner size may not vary very much although consumption and supply of toner particles are repeated. Additionally, the toner may not adhere or fix to a developing roller or a toner layer regulating blade. Thus, stable developability is provided for an extended period of time.

In some embodiments, the toner has a BET specific surface area of 0.5 to 4.0 $m^2/g$ or 0.5 to 2.0 $m^2/g$. When the BET specific surface area is less than 0.5 $m^2/g$, the particles of the resin A cover the surface of the toner particle so densely that the binder resin in the main body particle is prevented from adhering to a recording medium, resulting in deterioration of low-temperature fixability of the toner. Additionally, the particles of the resin A inhibit exuding of the release agent from the main body particle, resulting in deterioration of offset resistance. When the BET specific surface area is greater than 4.0 $m^2/g$, the particles of the resin A are coarsely stacked on the surface of the toner particle partially forming projecting parts. Thus, the binder resin in the main body particle is prevented from adhering to a recording medium, resulting in deterioration of low-temperature fixability of the toner. Additionally, the particles of the resin A inhibit exuding of the release agent from the main body particle, resulting in deterioration of offset resistance. Moreover, external additive particles easily release from the toner and adversely affect the resulting image quality.

The toner according to an embodiment may be used for a two-component developer in combination with a carrier. In some embodiments, the carrier has a weight average particle diameter of 15 to 40 μm. When the weight average particle diameter is less than 15 μm, it is likely that the carrier particles are transferred onto a recording medium together with toner particles and deposited on the resulting image. When the weight average particle diameter is greater than 40 μm, it is likely that background portions of the resulting image are soiled with toner particles when the toner concentration is high. Additionally, granularity in highlight portions may deteriorate when the dot size of a latent image is relatively small.

In an image forming method according to an embodiment, an electrophotographic photoreceptor is charged and an electrostatic latent image is formed on the charged electrophotographic photoreceptor. The electrostatic latent image is developed into a toner image with the toner according to an embodiment. The toner image is primarily transferred from the electrophotographic photoreceptor onto an intermediate transfer member and then secondarily transferred from the intermediate transfer member onto a recording medium. The toner image is fixed on the recording medium by application of heat and pressure. Residual toner particles remaining on the intermediate transfer member without being transferred onto the recording medium are removed. In some embodiments, the toner image is transferred from the intermediate transfer member onto the recording medium at a linear speed of 100 to 1,000 mm/sec within a time period of 0.5 to 60 msec.

An image forming apparatus according to an embodiment includes an electrophotographic photoreceptor, a charger, an irradiator, a developing device, a transfer device, a cleaning device, and a fixing device. In some embodiments, the image forming apparatus includes tandemly-disposed multiple sets of an electrophotographic photoreceptor, a charger, an irradiator, a developing device, a transfer device, and a cleaning device (hereinafter "tandem image forming apparatus"). The tandem image forming apparatus provides high-speed printing because a toner image of each color is formed on each of the multiple electrophotographic photoreceptors substantially at the same time. The toner images formed on the respective electrophotographic photoreceptors are superimposed on one another to form a full-color toner image.

Since the toner according to an embodiment provides reliable developability and adhesive force regardless of its color, each of the toner images uniformly adheres to the electrophotographic photoreceptor and recording medium, providing a full-color toner image having a high color reproducibility.

In some embodiments, the charger is configured to apply a direct current voltage overlapped with an alternating current voltage. The surface potential of the electrophotographic photoreceptor gets more stable and uniform when the electrophotographic photoreceptor is applied with a direct current voltage overlapped with an alternating current voltage rather than a direct current voltage. In some embodiments, the charger is configured to bring a charging member into contact with the electrophotographic photoreceptor and to apply a voltage to the charging member in contact with the electrophotographic photoreceptor. By applying a direct current overlapped with an alternating current to the charging member in contact with the electrophotographic photoreceptor, the electrophotographic photoreceptor is much more uniformly charged.

In some embodiments, the fixing device includes a heating roller, a fixing roller, a seamless fixing belt, and a pressing roller. The heating roller is comprised of a magnetic metal and is heatable by electromagnetic induction. The fixing roller is disposed in parallel with the heating roller. The fixing belt is stretched across the heating and fixing rollers and is heated by the heating roller and rotated by the heating and fixing rollers. The pressing roller is pressed against the fixing roller with the fixing belt therebetween and is rotatable in a forward direction relative to the fixing belt. In these embodiments, it is possible to heat the fixing belt within a short time period and to reliably control temperature. The fixing belt is capable of reliably fixing toner images even on a recording medium having a rough surface.

In some embodiments, the fixing device needs no oil or a slight amount of oil when fixing toner images a recording medium. In these embodiments, a release agent (e.g., a wax) is finely dispersed in the toner. The release agent exudes from the toner when the toner is being fixed on the recording medium. Therefore, the toner is prevented from transferring onto the fixing belt even when the fixing belt is applied with no oil or a slight amount of oil. To be finely dispersed in the toner, the release agent is incompatible with the binder resin of the toner. The release agent can be finely dispersed in the toner by adjusting manufacturing conditions. Dispersing condition of the release agent can be determined by observing a ultrathin section of the toner by a transmission electron microscope (TEM). When the dispersion diameter of the release agent is too small, the release agent may not satisfactorily exude from the toner. When the release agent domains are observable by TEM at a magnification of 10,000, the release agent is regarded to be dispersed in a proper condition. When the release agent domains are not observable by TEM at a magnification of 10,000, the release agent may not exude from the toner satisfactorily.

Weight average particle diameter (Dw), volume average particle diameter (Dv), and number average particle diameter (Dn) of the toner are measured by a particle size analyzer MULTISIZER III (from Beckman Coulter, Inc.) having an aperture size of 100 and an analysis software program Beckman Coulter Multisizer 3 Version 3.51 as follows. First, charge a 100-ml glass beaker with 0.5 ml of a 10% surfactant (an alkylbenzene sulfonate NEOGEN SC-A from Dai-ichi Kogyo Seiyaku Co., Ltd.). Add 0.5 g of a sample to the beaker and mix with a micro spatula. Further add 80 ml of ion-exchange water to the beaker. Subject the resulting dispersion to a dispersion treatment for 10 minutes using an ultrasonic disperser (W-113 MK-II from Honda Electronics). Subject the dispersion to a measurement by the MULTISIZER III using a measuring solution ISOTON III (from Beckman Coulter, Inc.). During the measurement, the amount of the dispersion is controlled so that the sample concentration is within 8±2%.

Average circularity SR is defined by the following formula:

$$SR(\%)=Cs/Cp\times 100$$

wherein Cp represents a peripheral length of a projected image of a particle and Cs represents a peripheral length of a circle having the same area as the projected image of the particle.

The average circularity of the toner is determined using a flow particle image analyzer FPIA-2100 (from Sysmex Corporation) and an analysis software FPIA-2100 Data Processing Program for FPIA version 00-10 as follows. First, charge a 100-ml glass beaker with 0.1 to 0.5 ml of a 10% surfactant (an alkylbenzene sulfonate NEOGEN SC-A from Dai-ichi Kogyo Seiyaku Co., Ltd.). Add 0.1 to 0.5 g of a sample to the beaker and mix with a micro spatula. Further add 80 ml of ion-exchange water to the beaker. Subject the resulting dispersion to a dispersion treatment for 3 minutes using an ultrasonic disperser (from Honda Electronics). Measure a shape distribution by FPIA-2100 when the dispersion has a concentration of 5,000 to 15,000 particles per micro-liter. In terms of measurement reproducibility, it is important to measure a shape distribution when the dispersion has a concentration of 5,000 to 15,000 particles per micro-liter. To make the dispersion have the desired concentration, the amount of surfactant or toner included in the dispersion may be varied. When the amount of surfactant in the dispersion is too large, noisy bubbles are undesirably generated. When the amount of surfactant in the dispersion is too small, toner particles cannot sufficiently get wet or dispersed. The proper amount of toner in the dispersion depends on particle diameter of toner. The smaller the particle diameter of toner, the smaller the proper amount of the toner. When a toner has a particle diameter of 3 to 7 μm, 0.1 to 0.5 g of the toner should be included in the dispersion so that the dispersion has a concentration of 5,000 to 15,000 particles per micro-liter.

BET specific surface area of the toner is measured by a micromeritics automatic surface area and porosimetry analyzer TriStar 3000 (from Shimadzu Corporation) as follows. Charge a measuring cell with 1 g of a sample. Deaerate the measuring cell by a deaeration unit VacuPrep 601 (from Shimadzu Corporation) for 20 hours at reduced pressures or 100 mtorr or less and at room temperature. Subject the deaerated measuring cell to a measurement of BET specific surface area by the TriStar 3000. Nitrogen gas is used as an adsorption gas.

The toner according to an embodiment includes a main body particle comprising toner components, a layer B comprising particles of a resin B, such as an acrylic resin, located overlying the main body particle, and a layer A comprising particles of a resin A, such as a styrene-acrylic resin, located overlying the layer B. The toner may be produced by dissolving or dispersing the toner components in an organic solvent to prepare a toner components liquid, emulsifying the toner components liquid in an aqueous medium containing particles of the resin A to prepare an emulsion, adding particles of the resin B to the aqueous medium, and removing the organic solvent from the emulsion to form toner particles. After removal of the organic solvent, the emulsion containing toner particles is heated at 40 to 60° C. so that the particles of the resin B are fixed on the surface of the toner particles. When the toner components liquid is emulsified in the aqueous medium, a dispersant can be used, for the purpose of stabilizing liquid droplets to obtain toner particles with a desired shape and a narrow particle size distribution. The dispersant may be, for example, a surfactant, a poorly-water-soluble inorganic compound, or a polymeric protection colloid. Two or more of these materials can be used in combination. In some embodiments, a surfactant is used. In some embodiments in which the binder resin includes a polyester resin, an anionic surfactant is used.

In some embodiments, styrene-acrylic resin particles or anionic styrene-acrylic resin particles are used. Anionic styrene-acrylic resin particles do not aggregate when being used in combination with an anionic surfactant. Anionic styrene-acrylic resin particles may be obtained by treating styrene-acrylic resin particles with an anionic activator or introducing an anionic group such as carboxyl group or sulfonic group into styrene-acrylic resin particles. In some embodiments, the styrene-acrylic resin particles have a primary particle diameter of 5 to 50 nm or 10 to 25 nm, which can reliably control particle size and particle size distribution of the emulsified particles. The particle diameter can be measured by scanning electron microscopy, transmission election microscopy, or light scattering methods. For example, volume average particle diameter can be measured by Particle Size Distribution Analyzer LA-9920 (from Horiba, Ltd.).

In some embodiments, acrylic resin particles are used. In some embodiments, the acrylic resin particles have a primary particle diameter of 10 to 500 nm or 10 to 200 nm, which can reliably control particle size and particle size distribution of the emulsified particles. The particle diameter can be measured by scanning electron microscopy, transmission election microscopy, or light scattering methods. As the acrylic resin particles get more unstable in the aqueous medium containing an anionic surfactant, the acrylic resin particles more easily adhere to liquid droplets of the toner components liquid.

Because of having a proper swelling property, the acrylic resin particles are capable of reliably forming the layer B in the granulation process. Swelling property of the acrylic resin particles can be controlled by varying cross-linking density or monomer composition.

In some embodiments, polyester resin particles are used, which may have a particle diameter of 10 to 500 nm, a molecular weight (Mw) of 1,000 to 200,000, a glass transition temperature (Tg) of 10 to 80° C., and an acid value of 10 to 30 mgKOH/g.

In some embodiments, polyol resin particles are used, which may be prepared by reacting a polyol (e.g., bisphenol A type polyol, alkylene oxide adduct bisphenol A type polyol, polyoxypropylene polyol) with an epoxy resin or a polyisocyanate and an optional polybasic acid in a small amount, which may be dissolved in a solvent if needed, in the presence of a catalyst such as tetramethylammonium chloride (for the epoxy resin) and an acid or a base (for the polyisocyanate) if needed, while monitoring residual amount of epoxy groups and isocyanate groups, and causing phase-transfer emulsification to obtain a water dispersion of the product.

Specific examples of usable binder resins include, but are not limited to, polyester resin, silicone resin, styrene-acrylic resin, styrene resin, acrylic resin, epoxy resin, diene resin, phenol resin, terpene resin, coumarin resin, amide imide resin, butyral resin, urethane resin, and ethylene-vinyl acetate resin.

Polyester resins can produce smooth image surface due to their sharply-melting property. Polyester resins have sufficient flexibility even when the molecular weight is low.

Usable polyester resin is obtained by reacting at least one polyol having the following formula (1) with at least one polycarboxylic acid having the following formula (2):

$$A\text{-}(OH)_m \quad (1)$$

wherein A represents an alkyl or alkylene group having 1 to 20 carbon atoms or a substituted or unsubstituted aromatic or heterocyclic aromatic group, and m represents an integer of 2 to 4;

$$B—(COOH)_n \quad (2)$$

wherein B represents an alkyl or alkylene group having 1 to 20 carbon atoms or a substitute or unsubstituted aromatic or heterocyclic aromatic group; and m represents an integer of 2 to 4.

Specific examples of usable polyols having the formula (1) include, but are not limited to, ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, bisphenol A, ethylene oxide adduct of bisphenol A, propylene oxide adduct of bisphenol A, hydrogenated bisphenol A, ethylene oxide adduct of hydrogenated bisphenol A, and propylene oxide adduct of hydrogenated bisphenol A.

Specific examples of usable carboxylic acids having the formula (2) include, but are not limited to, maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenyl succinic acid, isooctyl succinic acid, isododecenyl succinic acid, n-dodecyl succinic acid, isododecyl succinic acid, n-octenyl succinic acid, n-octyl succinic acid, isooctenyl succinic acid, isooctyl succinic acid, 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-hexanetricarboxylic acid, tetra(methylenecarboxyl)methane, 1,2,7,8-octanetetracarboxylic acid, pyromellitic acid, enpol trimmer acid, cyclohexanedicarboxylic acid, cyclohexenedicarboxylic acid, butanetetracarboxylic acid, diphenylsulfone tetracarboxylic acid, and ethylene glycol bis(trimellitic acid).

In some embodiments, the binder resin includes an unmodified binder resin and a reaction product of a compound having an active hydrogen group with a polymer reactive with the compound.

When toner components include the compound having an active hydrogen group and the polymer reactive with the compound, the resulting toner particles have better mechanical strength enough for preventing particles of the resin B or external additives from being buried in the toner particles. When the compound having an active hydrogen group is cationic, particles of an acrylic resin as the resin B are electrostatically attracted thereto. Also, it is possible to control fusibility upon application of heat to widen fixable temperature range of the toner. The compound having an active hydrogen group and the polymer reactive with the compound are both precursors of a binder resin.

The compound having an active hydrogen group acts as an elongater or a cross-linker for elongating or cross-linking the polymer reactive with the compound having an active hydrogen group in the aqueous medium. In some embodiments, the polymer reactive with compound having an active hydrogen group is a polyester prepolymer (A) having an isocyanate group and the compound having an active hydrogen group is an amine (B). This combination can produce a high-molecular-weight polyester by elongating and/or cross-linking reactions.

The active hydrogen group may be, for example, a hydroxyl group (e.g., an alcoholic hydroxyl group, a phenolic hydroxyl group), an amino group, a carboxyl group, or a mercapto group. Two or more of these groups can be included in combination.

The amine (B) may be, for example, a diamine (B1), a polyamine (B2) having 3 or more valences, an amino alcohol (B3), an amino mercaptan (B4), an amino acid (B5), or a blocked amine (B6) in which the amino group in any of the amines (B1) to (B5) is blocked. Two or more of these materials can be used in combination. In some embodiments, a diamine (B1) alone or a mixture of a diamine (B1) and a small amount of a polyamine (B2) having 3 or more valences is used.

Specific examples of the diamine (B1) include, but are not limited to, aromatic diamine, alicyclic diamine, and aliphatic diamine. Specific examples of the aromatic diamine include, but are not limited to, phenylenediamine, diethyltoluenediamine, and 4,4'-diaminodiphenylmethane. Specific examples of the alicyclic diamine include, but are not limited to, 4,4'-diamino-3,3'-dimethyldicyclohexylmethane, diamine cyclohexane, and isophoronediamine. Specific examples of the aliphatic diamine include, but are not limited to, ethylenediamine, tetramethylenediamine, and hexamethylenediamine.

Specific examples of the polyamine (B2) having 3 or more valences include, but are not limited to, diethylenetriamine and triethylenetetramine. Specific examples of the amino alcohol (B3) include, but are not limited to, ethanolamine and hydroxyethylaniline. Specific examples of the amino mercaptan (B4) include, but are not limited to, aminoethyl mercaptan and aminopropyl mercaptan. Specific examples of the amino acid (B5) include, but are not limited to, aminopropionic acid and aminocaproic acid.

Specific examples of the blocked amine (B6) include, but are not limited to, ketimine compounds obtained from the above-described amines (B1) to (B5) and ketones (e.g., acetone, methyl ethyl ketone, methyl isobutyl ketone), and oxazoline compounds.

The elongating and/or cross-linking reaction between the compound having an active hydrogen group and the polymer reactive with the compound having an active hydrogen group can be terminated by a reaction terminator to control molecular weight of the resulting resin. Specific examples of usable reaction terminators include, but are not limited to, monoamines (e.g., diethylamine, dibutylamine, butylamine, laurylamine) and blocked monoamines (e.g., ketimine compounds).

In some embodiments, the equivalent ratio [NCO]/[NHx] of isocyanate groups [NCO] in the polyester prepolymer (A) to amino groups [NHx] in the amine (B) is 1/3 to 3/1, 1/2 to 2/1, or 1/1.5 to 1.5/1. When the equivalent ratio [NCO]/[OH] is less than ⅓, low-temperature fixability of the toner may be poor. When the equivalent ratio [NCO]/[OH] is greater than 3/1, hot offset resistance of the toner may be poor because molecular weight of the resulting urea-modified polyester is too small.

The polymer reactive with the compound having an active hydrogen group (hereinafter "prepolymer") may be, for example, a polyol resin, a polyacrylic resin, a polyester resin, an epoxy resin, or a derivative resin thereof. Polyester resins are advantageous in terms of fluidity and transparency when melted. Two or more of these materials can be used in combination.

The prepolymer has a site reactive the compound having an active hydrogen group. The site may be, for example, an isocyanate group, an epoxy group, a carboxyl group, or an acid chloride group. Two or more of these groups can be included in combination. In some embodiments, the prepolymer has an isocyanate group. In some embodiments, the prepolymer is a polyester resin having an urea-bond-forming group (RMPE). It is easy to control molecular weight of high-molecular-weight components therein. RMPE can provide a toner having low-temperature fixability even in oilless fixing devices.

In some embodiments, the urea-bond-forming group is an isocyanate group. When the urea-bond-forming group of the polyester resin (PMPE) is an isocyanate group, the polyester resin (PMPE) may be the polyester prepolymer (A) having an isocyanate group. The polyester prepolymer (A) having an isocyanate group may be a reaction product of a polyester having an active hydrogen group, which is a polycondensation product of a polyol (PO) with a polycarboxylic acid (PC), with a polyisocyanate (PIC). Usable polyols (PO) include, for example, diols (DIO), polyols (TO) having 3 or more valences, and mixtures thereof. Two or more of these materials can be used in combination. In some embodiments, a diol (DIO) alone or a mixture of a diol (DIO) with a small amount of a polyol (TO) having 3 or more valences is used.

Specific examples of usable diols (DIO) include, but are not limited to, alkylene glycols, alkylene ether glycols, alicyclic diols, alkylene oxide adducts of alicyclic diols, bisphenols, alkylene oxide adducts of bisphenols.

Specific examples of usable alkylene glycols include, but are not limited to, alkylene glycols having 2 to 12 carbon atoms such as ethylene glycol, 1,2-propylene glycol, 1,3-propylene glycol, 1,4-butanediol, and 1,6-hexanediol. Specific examples of usable alkylene ether glycols include, but are not limited to, diethylene glycol, triethylene glycol, dipropylene glycol, polyethylene glycol, polypropylene glycol, and polytetramethylene ether glycol. Specific examples of usable alicyclic diols include, but are not limited to, 1,4-cyclohexanedimethanol and hydrogenated bisphenol A. Specific examples of usable alkylene oxide adducts of alicyclic diols include, but are not limited to, ethylene oxide adducts, propylene oxide adducts, and butylene oxide adducts of alicyclic diols. Specific examples of usable bisphenols include, but are not limited to, bisphenol A, bisphenol F, and bisphenol S. Specific examples of usable alkylene oxide adducts of bisphenols include, but are not limited to, ethylene oxide adducts, propylene oxide adducts, and butylene oxide adducts of bisphenols. In some embodiments, an alkylene glycol having 2 to 12 carbon atoms or an alkylene oxide adduct of a bisphenol is used. In some embodiments, an alkylene oxide adduct of a bisphenol alone or a mixture of an alkylene oxide adduct of a bisphenol and an alkylene glycol having 2 to 12 carbon atoms is used.

Specific examples of usable polyols (TO) having 3 or more valences include, but are not limited to, polyvalent aliphatic alcohols having 3 or more valences, polyphenols having 3 or more valences, and alkylene oxide adducts of polyphenols having 3 or more valences. Specific examples of usable polyvalent aliphatic alcohols having 3 or more valences include, but are not limited to, glycerin, trimethylolethane, trimethylolpropane, pentaerythritol, and sorbitol. Specific examples of usable polyphenols having 3 or more valences include, but are not limited to, trisphenols (e.g., trisphenol PA from Honshu Chemical Industry Co., Ltd.), phenol novolac, cresol novolac. Specific examples of usable alkylene oxide adducts of polyphenols having 3 or more valences include, but are not limited to, ethylene oxide adducts, propylene oxide adducts, and butylene oxide adducts of polyphenols having 3 or more valences.

In some embodiments, a mixture of 100 parts by weight of a diol (DIO) with 0.01 to 10 parts by weight, or 0.01 to 1 part by weight, of a polyol (TO) having 3 or more valences is used.

Usable polycarboxylic acids (PC) include, for example, dicarboxylic acids (DIC), polycarboxylic acids (TC) having 3 or more valences, and mixtures thereof. Two or more of these materials can be used in combination. In some embodiments, a dicarboxylic acid (DIC) alone or a mixture of a dicarboxylic acid (DIC) with a small amount of a polycarboxylic acid (TC) having 3 or more valences is used.

Specific examples of usable dicarboxylic acids (DIC) include, but are not limited to, alkylene dicarboxylic acids, alkenylene dicarboxylic acids, and aromatic dicarboxylic acids. Specific examples of usable alkylene dicarboxylic acids include, but are not limited to, succinic acid, adipic acid, and sebacic acid. Specific examples of usable alkenylene dicarboxylic acids include, but are not limited to, alkenylene dicarboxylic acids having 4 to 20 carbon atoms such as maleic acid and fumaric acid. Specific examples of usable aromatic dicarboxylic acids include, but are not limited to, phthalic acid, isophthalic acid, terephthalic acid, and naphthalenedicarboxylic acid. In some embodiments, an alkenylene dicarboxylic acid having 4 to 20 carbon atoms or an aromatic dicarboxylic acid having 8 to 20 carbon atoms is used.

Specific examples of usable polycarboxylic acids (TC) having 3 or more valences include, but are not limited to, aromatic polycarboxylic acids having 9 to 20 carbon atoms (e.g., trimellitic acid, pyromellitic acid).

Usable polycarboxylic acids (PC) further include acid anhydrides and lower alkyl esters (e.g., methyl ester, ethyl ester, isopropyl ester) of dicarboxylic acids (DIC), polycarboxylic acids (TC) having 3 or more valences, and mixtures thereof.

In some embodiments, a mixture of 100 parts by weight of a dicarboxylic acid (DIC) with 0.01 to 10 parts by weight, or 0.01 to 1 part by weight, of a polycarboxylic acid (TC) having 3 or more valences is used.

In some embodiments, the equivalent ratio [OH]/[COOH] of hydroxyl groups [OH] in the polyol (PO) to carboxyl groups [COOH] in the polycarboxylic acid (PC) is 2/1 to 1/1, 1.5/1 to 1/1, or 1.3/1 to 1.02/1.

In some embodiments, the content of the polyol (PO) in the polyester prepolymer (A) having an isocyanate group is 0.5 to 40% by weight, 1 to 30% by weight, or 2 to 20% by weight. When the content is less than 0.5% by weight, hot offset resistance, heat-resistant storage stability, and low-temperature fixability of the toner may be poor. When the content is greater than 40% by weight, low-temperature fixability of the toner may be poor.

Specific examples of usable polyisocyanates (PIC) include, but are not limited to, aliphatic polyisocyanates, alicyclic polyisocyanates, aromatic diisocyanates, aromatic aliphatic diisocyanates, isocyanurates, and those blocked with a phenol derivative, an oxime, or a caprolactam.

Specific examples of usable aliphatic polyisocyanates include, but are not limited to, tetramethylene diisocyanate, hexamethylene diisocyanate, 2,6-diisocyanatomethyl caproate, octamethylene diisocyanate, decamethylene diisocyanate, dodecamethylene diisocyanate, tetradecamethylene diisocyanate, trimethylhexane diisocyanate, and tetramethylhexane diisocyanate. Specific examples of usable alicyclic polyisocyanates include, but are not limited to, isophorone diisocyanate and cyclohexylmethane diisocyanate. Specific examples of usable aromatic diisocyanates include, but are not limited to, tolylene diisocyanate, diphenylmethane diisocyanate, 1,5-naphthylene diisocyanate, diphenylene-4,4'-diisocyanate, 4,4'-diisocyanato-3,3'-dimethyldiphenyl, 3-methyldiphenylmethane-4,4'-diisocyanate, and diphenyl ether-4,4'-diisocyanate. Specific examples of usable aromatic aliphatic diisocyanates include, but are not limited to, α,α,α',α'-tetramethylxylylene diisocyanate. Specific examples of usable isocyanurates include, but are not limited to, tris-isocyanatoalkyl isocyanurate and triisocyanatocycloalkyl isocyanurate. Two or more of these materials can be used in combination.

In some embodiments, the equivalent ratio [NCO]/[OH] of isocyanate groups [NCO] in the polyisocyanate (PIC) to hydroxyl groups [OH] in the polyester resin having an active hydrogen group is 5/1 to 1/1, 4/1 to 1.2/1, or 3/1 to 1.5/1. When the equivalent ratio [NCO]/[OH] is greater than 5/1, low-temperature fixability of the toner may be poor. When the equivalent ratio [NCO]/[OH] is less than 1/1, hot offset resistance of the toner may be poor.

In some embodiments, the content of the polyol (PIC) in the polyester prepolymer (A) having an isocyanate group is 0.5 to 40% by weight, 1 to 30% by weight, or 2 to 20% by weight. When the content is less than 0.5% by weight, hot offset resistance, heat-resistant storage stability, and low-temperature fixability of the toner may be poor. When the content is greater than 40% by weight, low-temperature fixability of the toner may be poor.

In some embodiments, the average number of isocyanate groups included in one molecule of the polyester prepolymer (A) having an isocyanate group is 1 or more, 1.2 to 5, or 1.5 to 4. When the average number of isocyanate groups is less than 1, hot offset resistance of the toner may be poor because molecular weight of the modified polyester (RMPE) having an urea-bond-forming group is too small.

In some embodiments, THF-soluble components in the polymer reactive with the compound having an active hydrogen group has a weight average molecular weight (Mw) of 3,000 to 40,000 or 4,000 to 30,000 measured by gel permeation chromatography (GPC). When the weight average molecular weight (Mw) is less than 3,000, heat-resistant storage stability of the toner may be poor. When the weight average molecular weight (Mw) is greater than 40,000, low-temperature fixability of the toner may be poor.

Molecular weight distribution can be measured by gel permeation chromatography (GPC) as follows. After stabilizing columns in a heat chamber at 40° C., flow THF (tetrahydrofuran) in the columns at a flow rate of 1 ml/min. Inject 50 to 200 μl of a THF solution of a sample having a concentration of 0.05 to 0.6% by weight. Molecular weight is determined with reference to a calibration curve compiled from several kinds of monodisperse polystyrene standard samples. The calibration curve may be complied from, for example, about 10 polystyrene standard samples having a molecular weight of $6\times10^2$, $2.1\times10^2$, $4\times10^2$, $1.75\times10^4$, $1.1\times10^5$, $3.9\times10^5$, $8.6\times10^5$, $2\times10^6$, and $4.48\times10^6$, available from Pressure Chemical Company or Tosoh Corporation. A refractive index detector can be used as the detector.

The binder resin includes a crystalline resin. In some embodiments, the binder resin includes a crystalline polyester resin having the following formula (3).

$$-(O-CO-(CR^1=CR^2)_m-CO-O-R^3)_n- \quad (3)$$

In the formula (3), m represents an integer of 1 or more, preferably 1 to 3, and n represents an integer of 1 or more. In the formula (3), each of $R^1$ and $R^2$ independently represents a hydrogen atom or a hydrocarbon group. The hydrocarbon group may be, for example, an alkyl group, an alkenyl group, or an aryl group. The hydrocarbon group may have a substituent. The alkyl group may be, for example, an alkyl group having 1 to 10 carbon atoms, such as methyl group, ethyl group, n-propyl group, isopropyl group, n-butyl group, isobutyl group, sec-butyl group, n-hexyl group, isohexyl group, n-heptyl group, n-octyl group, isooctyl group, n-decyl group, and isodecyl group. The alkenyl group may be, for example, an alkenyl group having 2 to 10 carbon atoms, such as vinyl group, aryl group, propenyl group, isopropenyl group, butenyl group, hexenyl group, and octenyl group. The aryl group may be, for example, an aryl group having 6 to 24 carbon atoms, such as phenyl group, tolyl group, xylyl group, cumenyl group, styryl group, mesityl group, cinnamyl group, phenethyl group, and benzhydryl group.

In the formula (3), $R^3$ represents a divalent hydrocarbon group. The divalent hydrocarbon group may be, for example, an alkylene group having 1 to 10 carbon atoms, such as a group represented by the formula $-(CH_2)_p-$, wherein p represents an integer of 1 to 10. In some embodiments, the divalent hydrocarbon group is a group represented by the formula $-CH_2-$, $-CH_2CH_2-$, $CH_2CH_2CH_2-$, or $CH_2C(CH_2)H-$.

Crystallinity and molecular structure of the crystalline polyester resin can be determined by NMR, differential scanning calorimetry (DSC), X-ray diffraction, GC/MS, LC/MS, or IR, for example. One exemplary method for determining crystallinity includes observing an infrared absorption spectrum to determine whether or not the spectrum has an absorption peak based on δCH (out-of-plane bending vibration) of olefin at $965\pm10\ cm^{-1}$ or $990\pm10\ cm^{-1}$. A resin having such an absorption peak is regarded as having crystallinity.

In some embodiments, o-dichlorobenzene-soluble components in the crystalline polyester have a molecular weight distribution obtained by gel permeation chromatography (GPC) such that a mass peak is observed within a log(M) range between 3.5 and 4.0 an the peak has a half bandwidth of 1.5 or less.

In some embodiments, the crystalline polyester resin has a weight average molecular weight (Mw) of 1,000 to 30,000 or 1,200 to 20,000. When the weight average molecular weight is less than 1,000, low-temperature fixability of the toner may be poor. When the weight average molecular weight is greater than 30,000, sharply-melting property of the toner may be poor. In some embodiments, the crystalline polyester resin has a number average molecular weight (Mn) of 5000 to 6,000 or 700 to 5,500. When the number average molecular weight is less than 500, low-temperature fixability of the toner may be poor. When the number average molecular weight is greater than 6,000, sharply-melting property of the toner may be poor. In some embodiments, the ratio (Mw/Mn) of the weight average molecular weight (Mw) to the number average molecular weight (Mn) is 2 to 8. When Mw/Mn is less than 2, it may be difficult to manufacture toner and may cost high. When Mw/Mn is greater than 8, sharply-melting property of the toner may be poor.

In some embodiments, the crystalline polyester resin has a melting temperature (Tm) of 50 to 150° C. or 60 to 130° C. determined from an endothermic peak temperature observed in differential scanning calorimetry (DSC). When the melting temperature (Tm) is less than 50° C., the resulting toner may cause blocking in a developing device. When the melting temperature (Tm) is greater than 150° C., low-temperature fixability of the resulting toner may be poor.

In some embodiments, the crystalline polyester resin has an acid value of 5 mgKOH/g or more, or 10 mgKOH/g or more. In some embodiments, the crystalline polyester resin has an acid value of 45 mgKOH/g in view of hot offset resistance. When the acid value is less than 5 mgKOH/g, low-temperature fixability of the toner may be poor because the resin has poor affinity for paper. The acid value of the crystalline polyester resin can be measured by dissolving the crystalline polyester resin in 1,1,1,3,3,3-hexafluoro-2-propanol solution and titrating the solution.

In some embodiments, the crystalline polyester resin has a hydroxyl value of 0 to 50 mgKOH/g or 5 to 50 mgKOH/g. When the hydroxyl value is greater than 50 mgKOH/g, low-temperature fixability and chargeability of the toner may be poor. The hydroxyl value of the crystalline polyester resin can be measured by dissolving the crystalline polyester resin in 1,1,1,3,3,3-hexafluoro-2-propanol solution and titrating the solution.

The crystalline polyester resin can be obtained from a polycondensation reaction between an alcohol and an acid.

The alcohol may be, for example, a diol. Specific examples of usable diols include, but are not limited to, 1,4-butanediol, ethylene glycol, 1,2-propylene glycol, 1,3-propylene glycol, 1,6-hexanediol, neopentyl glycol, 1,4-butenediol, 1,5-pentanediol, and derivatives thereof. Two or more of these materials can be used in combination. In some embodiments, 1,4-butanediol or 1,6-hexanediol is used. In some embodiments, the diol content in the alcohol is 80% by mol or more or 85 to 100% by mol. When the diol content in the alcohol is less than 80% by mol, manufacture efficiency may be poor.

The acid may be, for example, a carboxylic acid having C=C double bond, a dicarboxylic acid, or a polycarboxylic acid. Specific examples of usable dicarboxylic acids include, but are not limited to, oxalic acid, malonic acid, maleic acid, fumaric acid, citraconic acid, itaconic acid, glutaconic acid, succinic acid, and adipic acid; acid anhydrides thereof; and C1-C3 alkyl esters thereof. Two or more of the materials can be used in combination. In some embodiments, fumaric acid is used. In some embodiments, the dicarboxylic acid content in the acid is 80% by mol or more or 85 to 100% by mol. When the dicarboxylic acid content in the acid is less than 80% by mol, manufacture efficiency may be poor. Specific examples of usable polycarboxylic acids include, but are not limited to, trimellitic acid and pyromellitic acid; acid anhydrides thereof; and C1-C3 alkyl esters thereof.

The polycondensation reaction may occur at 120 to 230° C. under inert gas atmosphere using an esterification catalyst and/or a polymerization inhibitor, for example. To improve strength of the resulting crystalline polyester resin, all monomers may be reacted at once. To reduce low-molecular-weight in the resulting crystalline polyester resin, divalent monomers may be reacted first and subsequently trivalent or more valent monomers may be reacted. To accelerate the polycondensation reaction, the reaction system pressure may be reduced at the latter half of the reaction. To control crystallinity and softening point of the crystalline polyester resin, a non-linear polyester may be produced by reacting a polyol having 3 or more valences (e.g., glycerin) and a polycarboxylic acid having 3 or more valences (e.g., trimellitic anhydride).

The following is one example procedure for preparing a crystalline polyester resin. A 5-liter four-necked flask equipped with a nitrogen inlet pipe, a dewatering pipe, a stirrer, and a thermocouple is charged with 1,4-butanediol, fumaric acid, trimellitic anhydride, and hydroquinone. The mixture is subjected to a reaction for 5 hours at 160° C., subsequent 1 hour at 200° C. The mixture is further subjected to a reaction for 1 hour at 8.3 kPa. Thus, a crystalline polyester resin is prepared.

The toner may further includes a colorant, a release agent, a charge controlling agent, inorganic fine particles, a fluidity improving agent, a cleanability improving agent, a magnetic material, and/or a metal salt.

Specific examples of usable colorants include, but are not limited to, carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone. Two or more of these colorants can be used in combination.

In some embodiments, the content of the colorants in the toner is 1 to 15% by weight or 3 to 10% by weight. When the colorant content is less than 1% by weight, coloring power of the toner may be poor. When the colorant content is greater than 15% by weight, coloring power and electric property of the toner may be poor because the colorant cannot be uniformly dispersed in the toner.

The colorant can be combined with a resin to be used as a master batch. Specific examples of usable resins include, but are not limited to, polyester, polymers of styrene or styrene derivatives, styrene-based copolymers, polymethyl methacrylate, polybutyl methacrylate, polyvinyl chloride, polyvinyl acetate, polyethylene, polypropylene, epoxy resin, epoxy polyol resin, polyurethane, polyamide, polyvinyl butyral, polyacrylic acid resin, rosin, modified rosin, terpene resin, aliphatic or alicyclic hydrocarbon resin, aromatic petroleum resin, chlorinated paraffin, and paraffin wax. Two or more of these resins can be used in combination.

Specific examples of usable polymers of styrene or styrene derivatives include, but are not limited to, polystyrene, poly-p-chlorostyrene, and polyvinyl toluene. Specific examples of usable styrene-based copolymers include, but are not limited to, styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleate copolymer.

The master batch can be obtained by mixing and kneading a resin and a colorant while applying a high shearing force. To increase the interaction between the colorant and the resin, an organic solvent may be used. More specifically, the maser batch can be obtained by a method called flushing in which an aqueous paste of the colorant is mixed and kneaded with the resin and the organic solvent so that the colorant is transferred to the resin side, followed by removal of the organic solvent and moisture. This method is advantageous in that the resulting wet cake of the colorant can be used as it is without being dried. When performing the mixing or kneading, a high shearing force dispersing device such as a three roll mill may be used. The colorant can be included in an arbitrary resin phase, i.e., the main body (the first resin phase), the layer B (the second resin phase), or the layer A (the third resin phase), by controlling affinity difference. When the colorant is included in the inner first resin phase, charging properties such as environmental stability, charge retaining ability, and charge amount of the toner may not deteriorate.

In some embodiments, the toner includes a release agent having a melting point of 50 to 120° C. In a case in which such a low-melting-point release agent is dispersed in the binder resin, the toner can be effectively release from a fixing roller when the toner is fixed on a recording medium by being pressed by the fixing roller. Thus, the toner does not cause hot offset problem even when the fixing roller is not applied with any release agent such as oil.

Specific examples of such release agents include, but are not limited to, waxes. Specific examples of usable waxes include, but are not limited to, natural waxes such as plant waxes (e.g., carnauba wax, cotton wax, sumac wax, rice wax), animal waxes (e.g., bees wax, lanolin), mineral waxes (e.g., ozokerite, ceresin), and petroleum waxes (e.g., paraffin wax, micro-crystalline wax, petrolatum wax). Specific examples of usable waxes further include, but are not limited to, synthetic hydrocarbon waxes (e.g., Fischer-Tropsch wax, polyethylene wax) and synthetic waxes (e.g., ester wax, ketone wax, ether wax). Further, the following materials are also usable as the release agent: fatty acid amides such as 1,2-hydroxystearic acid amide, stearic acid amide, phthalic anhydride imide, and chlorinated hydrocarbon; homopolymers and copolymers of polyacrylates (e.g., n-stearyl polymethacrylate, n-lauryl polymethacrylate), which are low-molecular-weight crystalline polymers; and crystalline polymers having a long alkyl side chain. Two or more of these materials can be used in combination.

In some embodiments, the release agent has a melting point of 50 to 120° C. or 60 to 90° C. When the melting point is less than 50° C., heat-resistant storage stability of the toner may be poor. When the melting point is greater than 120° C., cold offset resistance of the toner may be poor. In some embodiments, the release agent has a melt-viscosity of 5 to 1,000 cps or 10 to 100 cps, at a temperature 20° C. higher than the melting point. When the melt-viscosity is less than 5 cps, releasability of the toner may be poor. When the melt-viscosity is greater than 1,000 cps, hot offset resistance and low-temperature fixability of the toner may be poor. In some embodiments, the content of the release agent in the toner is 0 to 40% by weight or 3 to 30% by weight. When the content of the release agent is greater than 40% by weight, fluidity of the toner may be poor.

The release agent can be included in an arbitrary resin phase, i.e., the main body (the first resin phase), the layer B (the second resin phase), or the layer A (the third resin phase), by controlling affinity difference. When the release agent is included in the second and third resin phases, the release agent can sufficiently exude upon application of heat within a short time period. When the release agent is included in the first resin phase, the release agent is prevented from contaminating photoreceptor and carrier particles.

Specific examples of usable charge controlling agents include, but are not limited to, nigrosine dyes, triphenylmethane dyes, chromium-containing metal complex dyes, chelate pigments of molybdic acid, Rhodamine dyes, alkoxyamines, quaternary ammonium salts (including fluorine-modified quaternary ammonium salts), alkylamides, phosphor and phosphor-containing compounds, tungsten and tungsten-containing compounds, fluorine activators, metal salts of salicylic acid, and metal salts of salicylic acid derivatives. Two or more of these materials can be used in combination.

Specific examples of commercially available charge controlling agents include, but are not limited to, BONTRON® 03 (nigrosine dye), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complexes of quaternary ammonium salts), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGER NX VP434 (quaternary ammonium salts), which are manufactured by Hoechst AG; LRA-901, and LR-147 (boron complex), which are manufactured by Japan Carlit Co., Ltd.; and cooper phthalocyanine, perylene, quinacridone, azo pigments, and polymers having a functional group such as a sulfonate group, a carboxyl group, and a quaternary ammonium group.

The charge controlling agent can be included in an arbitrary resin phase, i.e., the main body (the first resin phase), the layer B (the second resin phase), or the layer A (the third resin phase), by controlling affinity difference. When the charge controlling agent is included in the second or third resin phase, the charge controlling agent exerts an effect in a small amount. When the charge controlling agent is included in the first resin phase, the charge controlling agent is prevented from contaminating photoreceptor and carrier particles.

In some embodiments, the content of the charge controlling agent is 0.1 to 10 parts by weight or 0.2 to 5 parts by weight, based on 100 parts by weight of the binder resin. When the content of the charge controlling agent is less than 0.1 parts by weight, it is difficult to control charge of the toner. When the content of charge controlling agent is greater than 10 parts by weight, the toner may be excessively charged and excessively electrostatically attracted to a developing roller, resulting in poor fluidity of the developer and low image density.

The toner may further include fine particles of an inorganic material on the surface thereof to improve fluidity, developability, and chargeability. Specific examples of usable inorganic materials include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. Two or more of these materials can be used in combination.

Both large-sized inorganic fine particles having a particle diameter of 80 to 500 nm small-sized inorganic fine particles can be used. In some embodiments, the toner includes hydrophobized silica particles or hydrophobized titanium dioxide particles having a primary average particle diameter of 5 to 50 nm or 10 to 30 nm. In some embodiments, the fine particles have a BET specific surface of 2 to 500 $m^2/g$. In some embodiments, the toner includes large-sized inorganic fine particles and small-sized inorganic fine particles each in an amount of 0.01 to 5% by weight or 0.01 to 2.0% by weight.

In some embodiments, the inorganic material (e.g., silica, titanium oxide) is surface-treated with a fluidity improving agent, such as a silane coupling agent, a silylation agent, a silane coupling agent having a fluorinated alkyl group, an organic titanate coupling agent, an aluminum coupling agent, a silicone oil, and a modified silicone oil, to improve hydrophobicity. Such a hydrophobized inorganic material does not degrade fluidity and chargeability even in high-humidity conditions.

The toner may further include a cleanability improving agent so as to be easily removable from a photoreceptor or a primary transfer medium when remaining thereon after image transfer. Specific examples of usable cleanability improving agents include, but are not limited to, metal salts of fatty acids (e.g., zinc stearate, calcium stearate) and fine particles of polymers prepared by soap-free emulsion polymerization (e.g., polymethyl methacrylate, polystyrene). In some embodiments, the fine particles of polymers have a narrow size distribution and a volume average particle diameter of 0.01 to 1 μm.

Specific examples of usable magnetic materials include, but are not limited to, iron powder, magnetite, and ferrite. In some embodiments, a magnetic material having a whitish color is used.

The toner components liquid is prepared by dissolving or dispersing toner components liquid in a solvent or an organic solvent. The toner components may include, for example, a binder resin, a compound having an active hydrogen group, a polymer reactive with the compound having an active hydrogen group, a release agent, and a charge controlling agent. The organic solvent may be removed during or after the process of forming toner particles.

The organic solvent may be a volatile solvent having a boiling point less than 150° C., which is easily removable. Specific examples of such organic solvents include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. In some embodiments, an ester solvent is used. In some embodiments, ethyl acetate is used. Two or more of these solvents can be used in combination. In some embodiments, the used amount of the organic solvent is 40 to 300 parts by weight, 60 to 140 parts by weight, or 80 to 120 parts by weight, based on 100 parts by weight of the toner components. As described above, the toner components liquid is prepared by dissolving or dispersing toner components such as a compound having an active hydrogen group, a polymer reactive with the compound having an active hydrogen group, an unmodified polyester resin, a release agent, a colorant, and a charge controlling agent in an organic solvent. These toner components other than the polymer reactive with the compound having an active hydrogen group may be previously mixed with raw materials of the aqueous medium or may be added to the aqueous medium when the toner components is emulsified therein.

The aqueous medium may be, for example, water, a water-miscible solvent, or a mixture thereof. Specific examples of usable water-miscible solvents include, but are not limited to, alcohols, dimethylformamide, tetrahydrofuran, cellosolves, and lower ketones. Specific examples of the alcohols include, but are not limited to, methanol, isopropanol, and ethylene glycol. Specific examples of the lower ketones include, but are not limited to, acetone and methyl ethyl ketone. Two or more of these solvents can be used in combination.

Particles of the resin A are dispersed in the aqueous medium in the presence of an anionic surfactant. In some embodiments, the added amount of the anionic surfactant and particles of the resin A is each 0.5 to 10% by weight. Particles of the resin B are added to the aqueous medium thereafter. In a case in which the particles of the resin B and the anionic surfactant are cohesive, the aqueous medium may be subjected to a dispersion treatment with a high-speed shearing disperser before the process of emulsification.

The toner components liquid may be kept agitated when being emulsified in the aqueous medium. The toner components liquid is emulsified in the aqueous medium using a low-speed shearing disperser or a high-speed shearing disperser, for example. During the emulsification, the compound having an active hydrogen group is elongated or cross-linked with the polymer reactive with the compound having an active hydrogen group, thereby producing an adhesive base material (i.e., a binder resin). Particles of the resin B may be added to the aqueous medium either during or after the emulsification. In particular, particles of the resin B can be added to the aqueous medium during the emulsification while being agitated by a high-speed shearing disperser, or after the emulsification while being agitated by a low-speed sharing disperser. It depends on the degree of adherence or fixation of the particles of the resin B.

The organic solvent is removed from the emulsion. The organic solvent can be removed from the emulsion by (1) gradually heating the emulsion to completely evaporate the organic solvent from liquid droplets or (2) spraying the emulsion into dry atmosphere to completely evaporate the organic solvent from liquid droplets. In this case, aqueous dispersants, if any, can also be evaporated. After complete removal of the organic solvent from the emulsion, toner particles are obtained.

The toner particles thus obtained are washed with ion-exchange water and a dispersion of the toner particles having a desired conductivity is prepared.

The dispersion is then heated either statically or under agitation, so that the surfaces of the toner particles are smoothened. Alternatively, the toner particles can be heated either before or after being washed with ion-exchange water.

After being dried, the toner particles are classified by size. Undesired fine particles are removed by cyclone separation, decantation, or centrifugal separation, for example.

The dried toner particles are optionally mixed with fine particles of a colorant, a release agent, and/or a charge controlling agent, and these fine particles can be fixedly adhered to the surfaces of the toner particles by application of mechanical impulsive force. Mechanical impulsive force can be applied to the toner particles by agitating the toner particles using blades rotating at a high speed, or accelerating the toner particles in a high-speed airflow so that the toner particles collide with a collision plate. Such a treatment can be performed by ONG MILL (from Hosokawa Micron Co., Ltd.), a modified I-TYPE MILL in which the pulverizing air pressure is reduced (from Nippon Pneumatic Mfg. Co., Ltd.), HYBRIDIZATION SYSTEM (from Nara Machine Co., Ltd.), KRYPTON SYSTEM (from Kawasaki Heavy Industries, Ltd.), or an automatic mortar.

In an image forming method according to an embodiment, an electrophotographic photoreceptor is charged and an electrostatic latent image is formed on the charged electrophotographic photoreceptor. The electrostatic latent image is developed into a toner image with the toner according to an embodiment. The toner image is primarily transferred from the electrophotographic photoreceptor onto an intermediate transfer member and then secondarily transferred from the intermediate transfer member onto a recording medium. The toner image is fixed on the recording medium by application of heat and pressure. Residual toner particles remaining on the intermediate transfer member without being transferred onto the recording medium are removed. In some embodiments, the toner image is transferred from the intermediate transfer member onto the recording medium at a linear speed of 100 to 1,000 mm/sec within a time period of 0.5 to 60 msec. In some embodiments, the image forming method is applied to full-color tandem electrophotographic image forming methods.

A process cartridge according to an embodiment, detachably attachable to image forming apparatus, includes an electrophotographic photoreceptor to bear an electrostatic latent image, and a developing device containing the toner according to an embodiment. The developing device is configured to develop the electrostatic latent image into a toner image with the toner.

Figure 2:
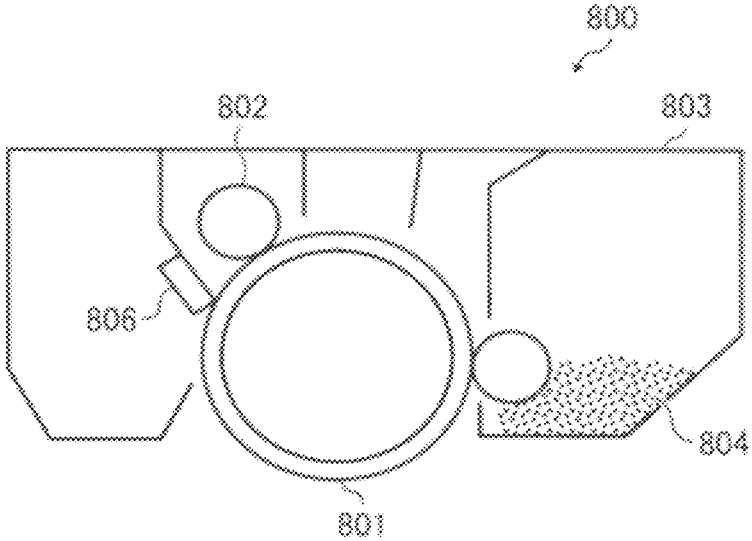
FIG. 2 is a schematic view of a process cartridge according to an embodiment.

FIG. 2 is a schematic view of a process cartridge according to an embodiment. A process cartridge 800 includes a photoreceptor 801, a charger 802, a developing device 803, and a cleaner 806. The photoreceptor 801 is driven to rotate at a predetermined peripheral speed. A peripheral surface of the photoreceptor 801 is uniformly charged by the charger 802 to a predetermined positive or negative potential and then exposed to light containing image information emitted from an irradiator such as a slit irradiator or a laser beam scanning irradiator. Thus, an electrostatic latent image is formed on the peripheral surface of the photoreceptor 801. The electrostatic latent image is developed into a toner image with a toner 804 in the developing device 803. The toner image is transferred from the photoreceptor 801 onto a recording medium which has been fed from a paper feed part to between the photoreceptor 801 and a transfer device in synchronization with a rotation of the photoreceptor 801. The recording medium having the toner image thereon is separated from the peripheral surface of the photoreceptor 801 and introduced into a fixing device. The recording medium having the fixed toner image thereon is discharged from the image forming apparatus as a copy. The cleaner 806 removes residual toner particles remaining on the peripheral surface of the photoreceptor 801 without being transferred. The cleaned photoreceptor 801 is neutralized to be ready for a next image forming operation.

Figure 3:
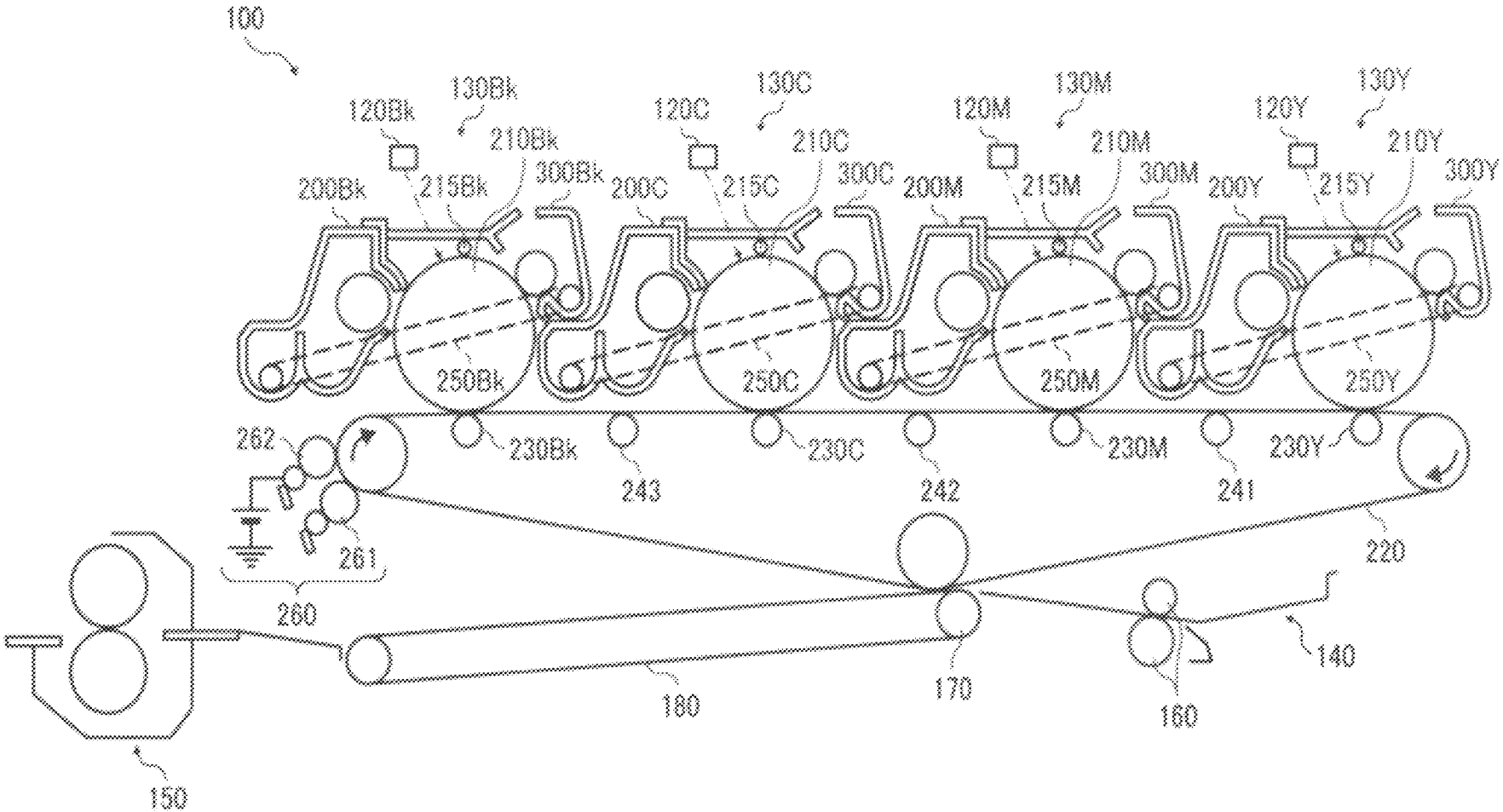
FIG. 3 and FIG. 4 are schematic views of an image forming apparatus according to an embodiment.
Figure 4:
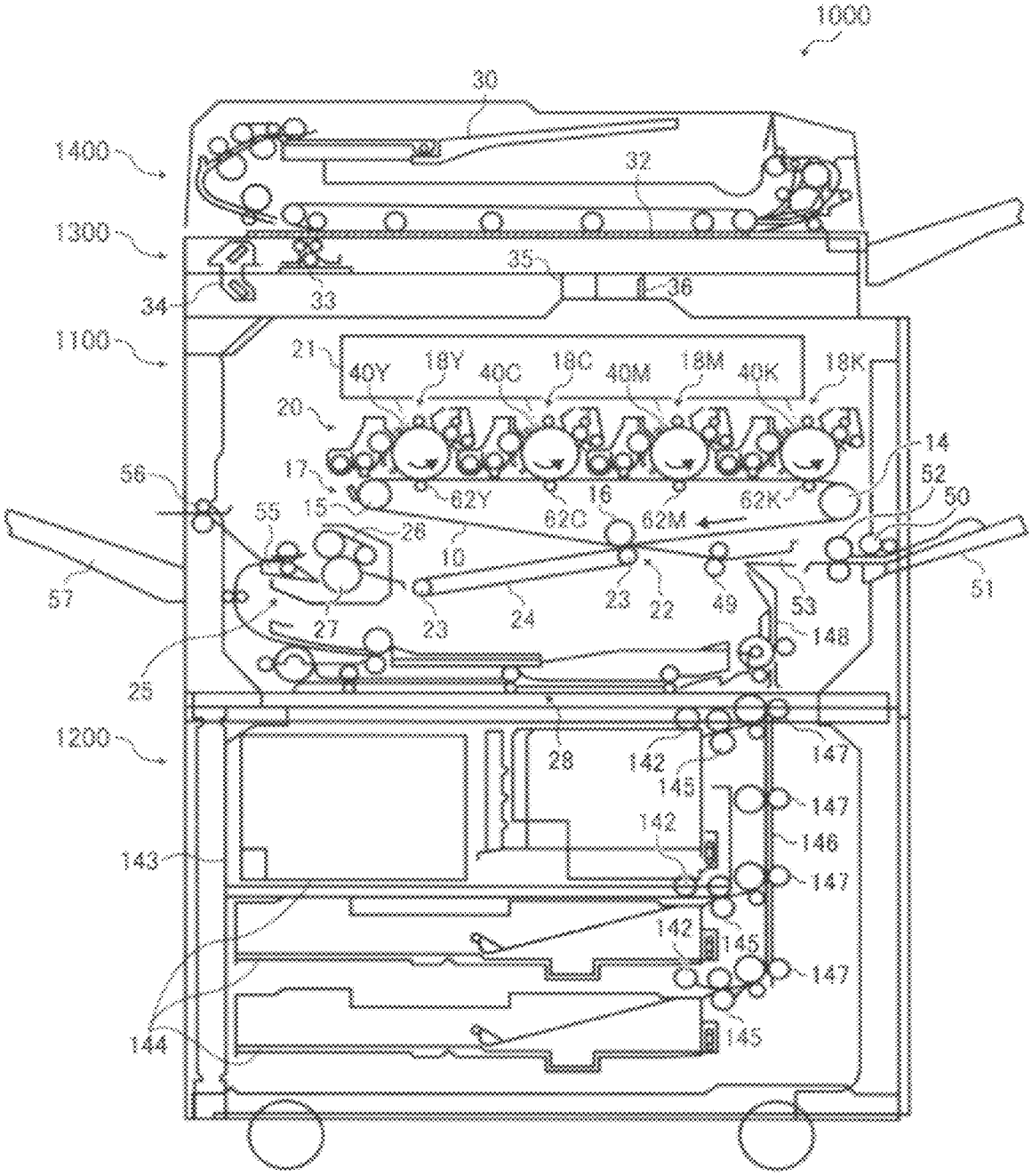

FIG. 3 and FIG. 4 are schematic views of an image forming apparatus according to an embodiment. In FIG. 3, an image forming apparatus 100 includes image writing parts 120Bk, 120C, 120M, and 120Y, image forming parts 130Bk, 130C, 130M, and 130Y, and a paper feed part 140. An image processing part converts image information into signals of black, cyan, magenta, and yellow and transmits them to the respective image writing parts 120Bk, 120C, 120M, and 120Y. Each of the image writing parts 120Bk, 120C, 120M, and 120Y is formed of a laser scanning optical system comprised of a deflector, such as a laser light source or a rotary polygon mirror, a scanning imaging optical system, and a group of mirrors. Each of image writing parts 120Bk, 120C, 120M, and 120Y has an optical path for writing an image in the respective image forming parts 130Bk, 130C, 130M, and 130Y.

The image forming parts 130Bk, 130C, 130M, and 130Y include respective photoreceptors 210Bk, 210C, 210M, and 210Y, each of which may be comprised of an organic photoconductor. Around the photoreceptors 210Bk, 210C, 210M, and 210Y, chargers 215Bk, 215C, 215M, and 215Y, irradiation parts irradiated with laser light beams emitted from image writing parts 120Bk, 120C, 120M, and 120Y, developing devices 200Bk, 200C, 200M, and 200Y, primary transfer devices 230Bk, 230C, 230M, and 230Y, cleaners 300Bk, 300C, 300M, and 300Y, and neutralizers are disposed, respectively. The developing devices 200Bk, 200C, 200M, and 200Y each employ a two-component magnetic brush developing method. An intermediate transfer belt 220 is disposed between the series of the photoreceptors 210Bk, 210C, 210M, and 210Y and the series of the primary transfer devices 230Bk, 230C, 230M, and 230Y. Toner images are transferred from the photoreceptor 210Bk, 210C, 210M, and 210Y onto the intermediate transfer belt 220 and superimposed on one another.

In some embodiments, a pre-transfer charger is disposed facing an outer surface of the intermediate transfer belt 220 downstream from the most downstream primary transfer position and upstream from the secondary transfer position. The pre-transfer charger is adapted to uniformly charge toner images having been transferred onto the intermediate transfer belt 220 in the primary transfer positions before the toner images are transferred onto a recording medium.

It is possible that the toner images transferred from the photoreceptors 210Bk, 210C, 210M, and 210Y onto the intermediate transfer belt 220 include a halftone portion, a solid portion, and a portion in which multiple-color toner images are overlapped, each of which having different charge amount. It is also possible that the toner images on the intermediate transfer belt 220 have variations in charge amount due to electric discharge occurred in the gaps formed at a downstream side from each primary transfer position. Such variations in charge amount reduce transfer efficiency in the secondary transfer position in which toner images are transferred from the intermediate transfer belt 220 onto a recording medium. The pre-transfer charger uniformly charges toner images transferred on the intermediate transfer belt 220 so as to improve transfer efficiency in the secondary transfer position.

By uniformly charging toner images having been transferred from the photoreceptors 210Bk, 210C, 210M, and 210Y onto the intermediate transfer belt 220 by the pre-transfer charger, the toner images can be efficiently and reliably transferred onto a recording medium even when the toner images have variation in charge amount.

Charge form the pre-transfer charger varies depending on the movement speed of the intermediate transfer belt 220. The smaller the movement speed of the intermediate transfer belt 220, the greater the charge amount of toner images on the intermediate transfer belt 220. This is because the toner images are exposed to the pre-transfer charger for a longer period of time as the movement speed of the intermediate transfer belt 220 gets slower. By contrast, the greater the movement speed of the intermediate transfer belt 220, the smaller the charge amount of toner images on the intermediate transfer belt 220. When the movement speed of the intermediate transfer belt 220 is variable during exposure of toner images to the pre-transfer charger, the pre-transfer charger is controlled so that the toner images have a constant charge regardless of the movement speed of the intermediate transfer belt 220.

Conductive rollers 241, 242, and 243 are disposed between adjacent primary transfer devices 230Bk, 230C, 230M, and 230Y. A sheet of transfer paper (hereinafter "transfer paper") is fed from the paper feed part 140 onto a secondary transfer belt 180 via a pair of registration rollers 160. The secondary transfer roller 170 transfers the toner image from the intermediate transfer belt 220 onto the transfer paper at a position where the intermediate transfer belt 220 is contacting the secondary transfer belt 180.

The secondary transfer belt 180 conveys the transfer paper having the toner image thereon to a fixing device 150. The toner image is fixed on the transfer paper in the fixing device 150. On the other hand, an intermediate transfer belt cleaner 260 removes residual toner particles remaining on the intermediate transfer belt 220 without being transferred onto the transfer paper.

The toner image on the intermediate transfer belt 220 has a negative polarity before being transferred onto the transfer paper. The secondary transfer roller 170 is applied with a positive voltage to cause transfer of the toner image onto the transfer paper. Residual toner particles remaining on the intermediate transfer belt 220 are charged to a positive polarity due to electric discharge occurred at the instant the transfer paper separates from the intermediate transfer belt 220. When paper jam is occurring or toner image is formed on non-image portions, toner particles are kept negatively charged without being positively charged by the secondary transfer roller 170.

In the present embodiment, each of the photoreceptors has a photosensitive layer having a thickness of 30 μm. The beam spot diameter of the optical system is 50×60 μm, and the light quantity is 0.47 mW. In the developing process, the potentials of non-irradiated and irradiated portions of the photoreceptor 210Bk are −700 V and −120 V, respectively, the developing bias voltage is −470 V, and the developing potential is 350 V. A black toner image formed on the photoreceptor 210Bk is transferred onto a transfer paper via the intermediate transfer belt 220 and finally fixed on the transfer paper. In the transfer process, each of the primary transfer devices 230Bk, 230C, 230M, and 230Y transfers respective toner images of black, cyan, magenta, and yellow onto the intermediate transfer belt 220 to form a composite toner image and the secondary transfer roller 170 transfers the composite toner image onto the transfer paper.

Referring to FIG. 3, the developing devices 200Bk, 200C, 200M, and 200Y are connected to the respective cleaners 300Bk, 300C, 300M, and 300Y with respective toner transfer tubes 250Bk, 250C, 250M, and 250Y indicated by dotted lines in FIG. 3. Each of the toner transfer tubes 250Bk, 250C, 250M, and 250Y has an internal screw for transferring toner particles collected in the respective cleaners 300Bk, 300C, 300M, and 300Y to the respective developing devices 200Bk, 200C, 200M, and 200Y.

Generally, in a direct transfer method in which toner images are directly transferred from four photoreceptors onto transfer paper conveyed by a belt conveyer, the photoreceptors are brought into direct contact with the transfer paper. In this method, toner particles collected from the photoreceptors cannot be recycled because of including an amount of paper powder, which may produce defective images. In another transfer method in which toner images are transferred from a single photoreceptor onto an intermediate transfer member, toner particles collected from the photoreceptor cannot be recycled because of including various color toner particles, which is difficult to separate into each color toner particles.

Unlike the above-described two methods, in the present embodiment employing the intermediate transfer belt 220 and four photoreceptors 210Bk, 210C, 210M, and 210Y, toner particles respectively collected by the cleaners 300Bk, 300C, 300M, and 300Y can be recycled because of including no paper powder.

Positively-charged toner particles remaining on the intermediate transfer belt 220 are removed by a conductive fur brush 262 to which a negative voltage is supplied. Another conductive fur brush 261 is supplied with a positive voltage. Most residual toner particles are removed by the conductive fur brushes 261 and 262. Residual toner particles, paper powder, talc, etc., which have not been removed by the conductive fur brush 261 are negatively charged by the conductive fur brush 262. The negatively charged residual toner particles are then conveyed to the primary transfer position facing the black photoreceptor 210Bk as the intermediate transfer belt 220 rotates, but are prevented from transferring onto the black photoreceptor 210Bk due to its polarity.

FIG. 4 is a schematic view of another image forming apparatus according to an embodiment. An image forming apparatus 1000 employs a tandem-type indirect transfer method. The image forming apparatus 1000 includes a main body 1100, a paper feed table 1200 disposed below the main body 1100, a scanner 1300 disposed above the main body 1100, and an automatic document feeder (ADF) 1400 disposed above the scanner 1300. A seamless-belt intermediate transfer member 10 is disposed at the center of the main body 1100.

The intermediate transfer member 10 is stretched across support rollers 14, 15, and 16 to be rotatable clockwise in FIG. 4. An intermediate transfer member cleaner 17 for removing residual toner particles remaining on the intermediate transfer member 10 is disposed on the left side of the support roller 15 in FIG. 4. Image forming units 118Y, 18C, 18M, and 18K for producing respective images of yellow, cyan, magenta, and black are disposed along a stretched surface of the intermediate transfer member 10 between the support rollers 14 and 15, thus forming a tandem image forming part 20.

An irradiator 21 is disposed immediately above the tandem image forming part 20. A secondary transfer device 22 is disposed on the opposite side of the tandem image forming part 20 relative to the intermediate transfer member 10. The secondary transfer device 22 includes a seamless secondary transfer belt 24 stretched between two rollers 23. The secondary transfer belt 24 is pressed against the support roller 16 with the intermediate transfer member 10 therebetween so that an image is transferred from the intermediate transfer member 10 onto a sheet of a recording medium. A fixing device 25 for fixing a toner image on the sheet is disposed adjacent to the secondary transfer device 22. The fixing device 25 includes a seamless fixing belt 26 and a pressing roller 27. The fixing belt 26 is pressed against the pressing roller 27. The secondary transfer device 22 has a function of conveying the sheet having the toner image thereon to the fixing device 25. In another embodiment, the secondary transfer device 22 may be comprised of for example, a transfer roller or a non-contact charger without sheet conveying function. A sheet reversing device 28 for reversing a sheet upside down is disposed below the secondary transfer device 22 and the fixing device 25, in parallel with the tandem image forming part 20.

To make a copy, a document is set on a document table 30 of the automatic document feeder 1400. Alternatively, a document is set on a contact glass 32 of the scanner 1300 while lifting up the automatic document feeder 1400, followed by holding down of the automatic document feeder 1400.

Upon pressing of a switch, in a case in which a document is set on the contact glass 32, the scanner 1300 immediately starts driving so that a first runner 33 and a second runner 34 start moving. In a case in which a document is set on the automatic document feeder 1400, the scanner 1300 starts driving after the document is fed onto the contact glass 32. The first runner 33 directs light from a light source to the document, and reflects a light reflected from the document toward the second runner 34. A mirror in the second runner 34 reflects the light toward a reading sensor 36 through an imaging lens 35. Thus, the document is read.

On the other hand, upon pressing of the switch, one of the support rollers 14, 15, and 16 is driven to rotate by a driving motor and the other two support rollers are driven to rotate by rotation of the rotating support roller so as to rotate and convey the intermediate transfer member 10. In the image forming units 18Y, 18C, 18M, and 18K, single-color toner images of yellow, cyan, magenta, and black are formed on photoreceptors 40Y, 40C, 40M, and 40K, respectively. The single-color toner images are sequentially transferred onto the intermediate transfer member 10 along conveyance of the intermediate transfer member 10 to form a composite full-color toner image thereon.

On the other hand, upon pressing of the switch, one of paper feed rollers 142 starts rotating in the paper feed table 1200 so that a sheet of a recording paper is fed from one of paper feed cassettes 144 in a paper bank 143. The sheet is separated by one of separation rollers 145 and fed to a paper feed path 146. Feed rollers 147 feed the sheet to a paper feed path 148 in the main body 1100. The sheet is stopped by a registration roller 49.

Alternatively, a recording paper may be fed from a manual feed tray 51 by rotating a feed roller 50, separated by a separation roller 52, fed to a manual paper feed path 53, and stopped by the registration roller 49.

The registration roller 49 feeds the sheet to between the intermediate transfer member 10 and the secondary transfer device 22 in synchronization with an entry of the composite full-color toner image formed on the intermediate transfer member 10.

The sheet is then fed to the fixing device 25 so that the composite full-color toner image is fixed thereon by application of heat and pressure. The sheet having the fixed toner image is switched by a switch claw 55 and discharged onto a discharge tray 57 by a discharge roller 56. Alternatively, the switch claw 55 switches paper feed paths so that the sheet gets reversed in the sheet reversing device 28. After forming another toner image on the back side of the sheet, the sheet is discharged onto the discharge tray 57 by rotating the discharge roller 56.

On the other hand, the intermediate transfer member cleaner 17 removes residual toner particles remaining on the intermediate transfer member 10 without being transferred. Thus, the tandem image forming part 20 gets ready for next image formation. Although the registration roller 49 is generally grounded, the registration roller 49 is applicable with a bias for the purpose of removing paper powders from the sheet.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

Measurement of BET Specific Surface Area

In Examples, BET specific surface area of toner was measured by a micromeritics automatic surface area and porosimetry analyzer TriStar 3000 (from Shimadzu Corporation) as follows. Charge a measuring cell with 1 g of a sample. Deaerate the measuring cell by a deaeration unit VacuPrep 601 (from Shimadzu Corporation) for 20 hours at reduced pressures or 100 mtorr or less and at room temperature. Subject the deaerated measuring cell to a measurement of BET specific surface area by the TriStar 3000. Nitrogen gas was used as an adsorption gas.

Preparation of Unmodified (Low-Molecular-Weight) Polyester

A reaction vessel equipped with a condenser, a stirrer, and a nitrogen inlet pipe was charged with 67 parts of ethylene oxide 2 mol adduct of bisphenol A, 84 parts of propylene oxide 3 mol adduct of bisphenol A, 274 parts of terephthalic acid, and 2 parts of dibutyltin oxide. The mixture was subjected to a reaction for 8 hours at 230° C. under normal pressures. The mixture was further subjected to a reaction for 5 hours under reduced pressures of 10 to 15 mmHg to obtain an unmodified polyester, followed by phase-transfer emulsification. Thus, an aqueous dispersion of the unmodified polyester was prepared.

The unmodified polyester had an acid value of 17 mgKOH/g, a particle diameter of 100 nm, a number average molecular weight (Mn) of 2,100, a weight average molecular weight (Mw) of 5,600, and a glass transition temperature (Tg) of 50° C.

Preparation of Master Batch

First, 1,000 parts of water, 540 parts of a carbon black (PRINTEX 35 from Degussa) having a DBP oil absorption of 42 ml/100 g and a pH of 9.5, and 1,200 parts of the unmodified polyester resin were mixed using a HENSCHEL MIXER (from Mitsui Mining and Smelting Co., Ltd.). The resulting mixture was kneaded for 30 minutes at 150° C. using double rolls, the kneaded mixture was then rolled and cooled, and the rolled mixture was then pulverized into particles using a pulverizer (from Hosokawa Micron Corporation). Thus, a master batch was prepared.

Preparation of Prepolymer

A reaction vessel equipped with a condenser, a stirrer, and a nitrogen inlet pipe was charged with 682 parts of ethylene oxide 2 mol adduct of bisphenol A, 81 parts of propylene oxide 2 mol adduct of bisphenol A, 283 parts of terephthalic acid, 22 parts of trimellitic anhydride, and 2 parts of dibutyltin oxide. The mixture was subjected to a reaction for 8 hours at 230° C. under normal pressures. The mixture was further subjected to a reaction for 5 hours under reduced pressures of 10 to 15 mmHg. Thus, an intermediate polyester was prepared. The intermediate polyester had a number average molecular weight (Mn) of 2,100, a weight average molecular weight (Mw) of 9,600, a glass transition temperature (Tg) of 55° C., an acid value of 0.5, and a hydroxyl value of 49.

Another reaction vessel equipped with a condenser, a stirrer, and a nitrogen inlet pipe was charged with 411 parts of the intermediate polyester, 89 parts of isophorone diisocyanate, and 500 parts of ethyl acetate. The mixture was subjected to a reaction for 5 hours at 100° C. Thus, a prepolymer (i.e., a polymer reactive with a compound having an active hydrogen group) was prepared. The prepolymer had a free isocyanate content of 1.60% and a solid content of 50% (after being left for 45 minutes at 180° C.).

Preparation of Crystalline Polyester

A 5-liter four-necked flask equipped with a nitrogen inlet pipe, a dewatering pipe, a stirrer, and a thermocouple was charged with 1,260 g of 1,6-butanediol, 120 g of ethylene glycol, 1,400 g of fumaric acid, 350 g of trimellitic anhydride, 3.5 g of tin octylate, and 1.5 g of hydroquinone. The mixture was subjected to a reaction for 5 hours at 160° C., subsequent 1 hour at 200° C., and further 1 hour at 8.3 kPa. Thus, a crystalline polyester resin was prepared. The crystalline polyester had a melting point of 89° C.

Preparation of Toner Components Liquid

In a beaker, 100 parts of the unmodified polyester resin were dissolved in 130 parts of ethyl acetate. Further, 10 parts of a carnauba wax (having a molecular weight of 1,800, an acid value of 2.5, and a penetration of 1.5 mm (at 40° C.)), 10 parts of the crystalline polyester, and 10 parts of the master batch were added to the beaker. The resulting mixture was subjected to a dispersion treatment using a bead mill (ULTRAVISCOMILL (trademark) from Aimex Co., Ltd.) filled with 80% by volume of zirconia beads having a diameter of 0.5 mm, at a liquid feeding speed of 1 kg/hour and a disc peripheral speed of 6 m/sec. This dispersing operation was repeated 3 times (3 passes). Thereafter, 40 parts of the prepolymer were further added to the mixture. Thus, a toner components liquid was prepared.

Preparation of Styrene-acrylic Resin Particles

A reaction vessel equipped with a stirrer and a thermometer was charged with 683 parts of water, 16 parts of a sodium salt of a sulfate of ethylene oxide adduct of methacrylic acid (ELEMINOL RS-30 from Sanyo Chemical Industries, Ltd.), 83 parts of styrene, 83 parts of methacrylic acid, 110 parts of butyl acrylate, and 1 part of ammonium persulfate. The mixture was agitated for 15 minutes at a revolution of 400 rpm, thus preparing a white emulsion. The white emulsion was heated to 75° C. and subjected to reaction for 5 hours. A 1% aqueous solution of ammonium persulfate in an amount of 30 parts was further added to the emulsion, and the mixture was aged for 5 hours at 75° C. Thus, an aqueous dispersion of styrene-acrylic resin particles A1, which were particles of a vinyl resin (i.e., a copolymer of styrene, methacrylic acid, butyl acrylate, and a sodium salt of a sulfate of ethylene oxide adduct of methacrylic acid), was prepared. The styrene-acrylic resin particles A1 had a volume average particle diameter of 14 nm measured by a laser diffraction particle size distribution analyzer LA-920 (from Horiba, Ltd.), an acid value of 45 mgKOH/g, a weight average molecular weight (Mw) of 300,000, and glass transition temperature (Tg) of 60° C.

Preparation of Acrylic Resin Particles

A reaction vessel equipped with a stirrer and a thermometer was charged with 683 parts of water, 10 parts of distearyl dimethyl ammonium chloride (CATION DS from Kao Corporation), 144 parts of methyl methacrylate, 50 parts of butyl acrylate, 1 part of ammonium persulfate, and 2 parts of ethylene glycol dimethacrylate. The mixture was agitated for 15 minutes at a revolution of 400 rpm, thus preparing a white emulsion. The white emulsion was heated to 65° C. and subjected to a reaction for 10 hours. A 1% aqueous solution of ammonium persulfate in an amount of 30 parts was further added to the emulsion, and the mixture was aged for 5 hours at 75° C. Thus, an an aqueous dispersion of acrylic resin particles B1, which were particles of a methyl-methacrylate-based vinyl resin, was prepared. The acrylic resin particles B1 had a volume average particle diameter of 35 nm measured by a laser diffraction particle size distribution analyzer LA-920 (from Horiba, Ltd.), an acid value of 2 mgKOH/g, a weight average molecular weight (Mw) of 30,000, and glass transition temperature (Tg) of 63° C.

The above procedure for preparing the dispersion of the acrylic resin particles B1 was repeated except for changing the amount of ethylene glycol dimethacrylate from 2 parts to 1 part and 4 parts to prepare dispersions of acrylic resin particles B2 and B3, respectively. The above procedure for preparing the dispersion of the acrylic resin particles B1 was repeated except for changing the amount of ethylene glycol dimethacrylate from 2 parts to 0 parts to prepare a dispersion of acrylic resin particles B4.

Preparation of Polyester Resin Particles

A reaction vessel equipped with a condenser, a stirrer, and a nitrogen inlet pipe was charged with 67 parts of ethylene oxide 2 mol adduct of bisphenol A, 84 parts of propylene oxide 3 mol adduct of bisphenol A, 274 parts of terephthalic acid, and 2 parts of dibutyltin oxide. The mixture was subjected to a reaction for 8 hours at 230° C. under normal pressures. The mixture was further subjected to a reaction for 5 hours under reduced pressures of 10 to 15 mmHg to obtain a unmodified polyester, followed by phase-transfer emulsification. Thus, an aqueous dispersion of polyester resin particles C1 having an average particle diameter of 48 nm was prepared.

Preparation of Polyol Resin Particles

A 50-ml separable flask equipped with a stirrer, a thermometer, a nitrogen inlet, and a condenser was charged with 156.1 parts of a low-molecular-weight bisphenol A-type liquid epoxy resin (EPOMIK R140P from Mitsui Chemicals, Inc., having an epoxy equivalent of 188 g/equivalent and a viscosity of 13,500 mPa·s), 15.0 parts of a high-molecular-weight bisphenol A-type liquid epoxy resin (EPOMIK R309R from Mitsui Chemicals, Inc., having an epoxy equivalent of 2,630 g/equivalent), 60.3 parts of bisphenol A, 23.6 parts of benzoic acid, 45.0 parts of phthalic anhydride adduct of propylene oxide adduct of bisphenol A (KB-280 from Mitsui Chemicals, Inc.), and 33.3 parts of styrene. The flask was heated under nitrogen atmosphere to have an inner temperature of 80° C. and 0.12 parts of a 50% aqueous solution of tetramethylammonium chloride as a reaction catalyst were added thereto. The flask was further heated to have an inner temperature of 160° C. to initiate a reaction. After the reaction for 1 hour, 0.12 parts of a 50% aqueous solution of tetramethylammonium chloride were added to the flask again. The inner pressure was reduced to 10 mmHg over a period of about 1 hour to concentrate the xylene while keeping the inner temperature to 160° C. The reaction mixture was agitated at 160° C. to initiate a reaction again.

It was confirmed by periodical measurement that the residual amount of epoxy groups exceeded 20,000 g/equivalent after the 6-hour reaction, which meant that epoxy groups had substantially diminished. The resulting polyol resin in a melted condition was taken out of the flask. The resin was subjected to phase-transfer emulsification. Thus, an aqueous dispersion of the polyol resin particles D1 having an average particle diameter of 52 nm was prepared.

Evaluation of Swelling Property of Resin Particles

Each of the dispersions of resin particles were contained in a 30-ml screw vial (from AS ONE Corporation) with a measuring pipette so that its height from the bottom became 20 mm. After further adding 10 ml of ethyl acetate with a measuring pipette, the vial was left for 24 hours so that the mixture was separated into a lower white resin emulsion phase and an upper ethyl acetate phase. Swelling property was evaluated by the height of the lower white resin emulsion phase from the bottom of the vial. The higher the swelling property, the greater the height of the lower white resin emulsion phase.

Swelling property was graded into the following four ranks in terms of the height of the lower white resin emulsion phase. Resin particles in the ranks A, B, and C have swelling property.

A: The height was not less than 25 mm or more. Swells sufficiently.

B: The height was not less than 21 mm and less than 25 mm. Swells well.

C: The height was not less than 20 mm and less than 21 mm. Swells insufficiently.

D: The height was less than 20 mm. Not swell.

Properties of the above-prepared resin particles are shown in Table 1.

TABLE 1

| Resin Particles | | Swelling Property | Compatibility with Binder Resin | Volume Average Particle Diameter (nm) |
|---|---|---|---|---|
| A1 | Styrene-Acrylic | B | Incompatible | 14 |
| B1 | Acrylic | B | Incompatible | 35 |
| B2 | Acrylic | A | Incompatible | 42 |
| B3 | Acrylic | C | Incompatible | 108 |
| B4 | Acrylic | A | Incompatible | 193 |
| C1 | Polyester | B | Incompatible | 48 |
| D1 | Polyol | B | Incompatible | 52 |

Example 1

Preparation of Toner a

Preparation of Aqueous Medium

First, 660 parts of water, 25 parts of the dispersion of the styrene-acrylic resin particles A1, 25 parts of a 48.5% aqueous solution of dodecyl diphenyl ether sodium disulfonate (ELEMINOL MON-7 from Sanyo Chemical Industries, Ltd.), and 60 parts of ethyl acetate were mixed. Further, 50 parts of the dispersion the acrylic resin particles B1 were added to the mixture. Thus, an aqueous medium was obtained.

Aggregations having a size of several hundred μm were observed in the aqueous medium by an optical microscope. The aqueous medium was agitated by a TK HOMOMIXER (from Primix Corporation) at a revolution of 8,000 rpm. As a result, it was observed by an optical microscope that the aggregations were loosened into small aggregations having several μm. Thus, it was expected that the acrylic resin particles B1 could uniformly adhere to liquid droplets of the toner components liquid in a subsequent emulsification process because the aggregations had been loosened.

Preparation of Emulsion Slurry

While agitating 150 parts of the aqueous medium in a vessel at a revolution of 12,000 rpm using a TK HOMOMIXER (from PRIMIX Corporation), 100 parts of the toner components liquid and isophorone diamine as an elongater in an amount of 1% by mol based on the content of the free isocyanate were mixed therein for 10 minutes. Thus, an emulsion slurry was prepared.

Removal of Organic Solvents

A flask equipped with a degassing tube, a stirrer, and a thermometer was charged with 100 parts of the emulsion slurry. The emulsion slurry was agitated for 12 hours at 30° C. at a peripheral speed of 20 m/min under reduced pressures so that the organic solvents were removed therefrom. Thus, a dispersion slurry was prepared.

Washing

The dispersion slurry was filtered under reduced pressures and mixed or redispersed with 300 parts of ion-exchange water using a TK HOMOMIXER for 10 minutes at a revolution of 12,000 rpm, followed by filtering, thus obtaining a wet cake. The wet cake was mixed with 300 parts of ion-exchange water using a TK HOMOMIXER for 10 minutes at a revolution of 12,000 rpm, followed by filtering. This operation was repeated three times, thus obtaining a washed slurry having a conductivity of 0.1 to 10 μS/cm.

Heating Treatment

In a flask equipped with a stirrer and a thermometer, the washed slurry was agitated for 60 minutes at 50° C. at a peripheral speed of 20 m/min so that the acrylic resin particles B1 were fixed on the surfaces of the toner particles, followed by filtering.

Drying

The heated cake was dried by a drier for 48 hours at 45° C. and filtered with a mesh having openings of 75 μm. Thus, a mother toner a was prepared.

External Treatment

The mother toner a in an amount of 100 parts was mixed with 0.6 parts of a hydrophobized silica having an average particle diameter of 100 nm, 1.0 part of a titanium oxide having an average particle diameter of 20 nm, and 0.8 parts of a hydrophobized silica having an average particle diameter of 15 nm using a HENSCHEL MIXER. Thus, a toner a was prepared.

Example 2

Preparation of Toner b

The procedure in Example 1 was repeated except for replacing the acrylic resin particles B1 with the acrylic resin particles B2. Thus, a toner b was prepared. The acrylic resin particles B2 were incompatible with the binder resin and had high swelling property due to their weak cross-linking structures. Aggregations having a size of several hundred μm were observed by an optical microscope in the aqueous medium to which the acrylic resin particles B2 were added. The aqueous medium was agitated by a TK HOMOMIXER (from Primix Corporation) at a revolution of 8,000 rpm. As a result, it was observed by an optical microscope that the aggregations were loosened into small aggregations having several μm. Thus, it was expected that the acrylic resin particles B2 could uniformly adhere to liquid droplets of the toner components liquid in a subsequent emulsification process because the aggregations had been loosened.

Example 3

Preparation of Toner c

The procedure in Example 1 was repeated except for replacing the acrylic resin particles B1 with the acrylic resin particles B3. Thus, a toner c was prepared. The acrylic resin particles B3 were incompatible with the binder resin and had poorer swelling property than the acrylic resin particles B1 due to their strong cross-linking structures. Aggregations having a size of several hundred μm were observed by an optical microscope in the aqueous medium to which the acrylic resin particles B3 were added. The aqueous medium was agitated by a TK HOMOMIXER (from Primix Corporation) at a revolution of 8,000 rpm. As a result, it was observed by an optical microscope that the aggregations were loosened into small aggregations having several μm. Thus, it was expected that the acrylic resin particles B3 could uniformly adhere to liquid droplets of the toner components liquid in a subsequent emulsification process because the aggregations had been loosened.

Example 4

Preparation of Toner d

The procedure in Example 1 was repeated except for replacing the acrylic resin particles B1 with the acrylic resin particles B4. Thus, a toner d was prepared. The acrylic resin particles B4 were incompatible with the binder resin and had high swelling property due to their weak cross-linking structures. Aggregations having a size of several hundred μm were observed by an optical microscope in the aqueous medium to which the acrylic resin particles B4 were added. The aqueous medium was agitated by a TK HOMOMIXER (from Primix Corporation) at a revolution of 8,000 rpm. As a result, it was observed by an optical microscope that the aggregations were loosened into small aggregations having several μm. Thus, it was expected that the acrylic resin particles B4 could uniformly adhere to liquid droplets of the toner components liquid in a subsequent emulsification process because the aggregations had been loosened.

Example 5

Preparation of Toner e

The procedure in Example 5 is repeated except that the unmodified polyester is replaced with a styrene-acrylic resin prepared in the same manner as the styrene-acrylic resin A1, the styrene-acrylic resin particles A1 are replaced with polyester resin particles C1, and the acrylic resin particles B1 are replaced with the polyol resin particles. Thus, a toner e is prepared. The resins used in the toner e are incompatible with each other.

Example 6

Preparation of Toner f

The procedure in Example 1 was repeated except for replacing the styrene-acrylic resin particles A1 with styrene-acrylic resin particles A2 having a cross-linking structure formed by the use of ethylene glycol dimethacrylate. Thus, a toner f was prepared. The resins used in the toner f were incompatible with each other.

Example 7

Preparation of Toner g

The procedure in Example 1 was repeated except that the styrene-acrylic resin particles A1 were replaced with styrene-acrylic resin particles A2 having a cross-linking structure formed by the use of ethylene glycol dimethacrylate and the acrylic resin particles B1 were replaced with the acrylic resin particles B4. Thus, a toner g was prepared. The resins used in the toner g were incompatible with each other.

Comparative Example 1

Preparation of Toner a'

The procedure in Example 1 was repeated except that the acrylic resin particles B1 were not used. Thus, a toner a' was prepared.

Comparative Example 2

Preparation of Toner b'

The procedure in Example 1 was repeated except that the amount of the styrene-acrylic resin particles A1 was changed to 3 times that in Example 1 and the acrylic resin particles B1 were not used. Thus, a toner b' was prepared.

Comparative Example 3

Preparation of Toner c'

The procedure in Example 1 was repeated except that the crystalline polyester was not used. Thus, a toner c' was prepared.

Properties of the above-prepared toners are shown in Table 2.

TABLE 2

| | Toner | Resin Particles A | Resin Particles B | Particle Diameter (μm) | Circularity | BET Specific Surface Area ($m^2/g$) |
|---|---|---|---|---|---|---|
| Example 1 | a | A1 | B1 | 5.0 | 0.967 | 1.5 |
| Example 2 | b | A1 | B2 | 5.0 | 0.952 | 1.6 |
| Example 3 | c | A1 | B3 | 5.1 | 0.972 | 2.1 |
| Example 4 | d | A1 | B4 | 4.9 | 0.967 | 1.5 |
| Example 5 | e | C1 | D1 | 5.2 | 0.962 | 1.8 |
| Example 6 | f | A2 | B1 | 5.6 | 0.963 | 1.4 |
| Example 7 | g | A2 | B4 | 5.4 | 0.967 | 1.5 |
| Comparative Example 1 | a' | A1 | — | 5.2 | 0.967 | 2.5 |
| Comparative Example 2 | b' | A1 | — | 3.1 | 0.975 | 4.3 |
| Comparative Example 3 | c' | A1 | B1 | 5.2 | 0.966 | 1.8 |

Preparation of Carrier

A covering layer liquid was prepared by dispersing 21.0 parts of an acrylic resin solution (having a solid content of 50%), 6.4 parts of a guanamine solution (having a solid content of 70%), 7.6 parts of alumina particles (having an average particle diameter of 0.3 μm and a specific resistivity of $10^{14}\Omega\cdot$cm), 65.0 parts of a silicone resin solution (SR2410 from Dow Corning Toray Co., Ltd, having a solid content of 23%), 1.0 part of an aminosilane (SH6020 from Dow Corning Toray Co., Ltd, having a solid content of 100%), 60 parts of toluene, and 60 parts of butyl cellosolve, for 10 minutes using a HOMOMIXER. The covering layer liquid was applied to the surfaces of calcined ferrite particles ($(MgO)_{1.8}(MnO)_{49.5}(Fe_2O_3)_{48.0}$, having an average particle diameter of 25 μm) using a SPIRA COTA (from Okada Seiko Co., Ltd.), followed by drying, so that a covering layer having a thickness of 0.15 μm was formed thereon. The ferrite particles having the covering layer were burnt in an electric furnace for 1 hour at 150° C. The ferrite particles were then pulverized with a sieve having openings of 106 μm. Thus, a carrier A was prepared. The average thickness of the covering layer was determined by observing a cross-section of the carrier particles using a transmission electron microscope (TEM). The carrier A had a weight average particle diameter of 35 μm.

Preparation of Two-Component Developer

Each of the above-prepared toners in an amount of 7 parts and the carrier A in an amount of 100 parts were uniformly mixed by a TURBULA MIXER to prepare each two-component developer.

Evaluation of Transfer Efficiency (%)

An image forming apparatus DocuColor 8000 Digital Press (from Fuji Xerox Co., Ltd.) was modified such that the linear speed and the transfer time were changed to 162 mm/sec and 40 msec, respectively. Each of the developers prepared above was set in the image forming apparatus and a running test was performed in which a solid pattern having a toner content 0.6 mg/cm$^2$ was continuously produced on A4 sheets. At the initial stage of the running test and after production of the 100,000th image, transfer efficiency in the primary and secondary transfer processes were determined from the following formulae (3) and (4).

$$\text{Primary transfer efficiency}(\%)=(T(I)/T(P))\times 100 \quad (3)$$

wherein (T(I) represents the amount of toner particles transferred onto an intermediate transfer member and T(P) represents the amount of toner particles developed on a photoreceptor.

$$\text{Secondary transfer efficiency}(\%)=\{(T(I)-T(R))/T(I)\}\times 100 \quad (4)$$

wherein (T(I) represents the amount of toner particles transferred onto an intermediate transfer member and T(R) represents the amount of residual toner particles remaining on the intermediate transfer member.

Transfer efficiency was graded into the following four ranks in terms of the average of the primary and secondary transfer efficiencies as follows.

A: not less than 90%

B: not less than 85% and less than 90%

C: not less than 80% and less than 85%

D: less than 80%

Evaluation of Minimum Fixable Temperature

An image forming apparatus Imagio Neo C600 Pro (from Ricoh Co., Ltd.) was modified so that the temperature and linear speed of the fixing part were variable. Each of the toners was set in the apparatus and solid images having a toner content of 0.85±0.1 mg/cm$^2$ were formed on sheets of a thick paper <135> (from Ricoh Co., Ltd.) while varying the temperature of the fixing part. The minimum fixable temperature is a temperature below which the residual rate of image density after rubbing the solid image falls below 70% and was graded into the following four ranks.

A: less than 120° C.

B: less than 140° C. and not less than 120° C.

C: less than 160° C. and not less than 140° C.

D: not less than 160° C.

Evaluation of Maximum Fixable Temperature

Each of the toners was set in the modified image forming apparatus Imagio Neo C600 Pro and solid images having a toner content of 0.85±0.3 mg/cm$^2$ were formed on sheets of a normal paper TYPE 6000 <70W> (from Ricoh Co., Ltd.) while varying the temperature of the fixing part. The maximum fixable temperature is a temperature above which hot offset problem occurs. The maximum temperature at which hot offset problem occurred was graded into the following four ranks.

A: not less than 210° C.

B: less than 210° C. and not less than 190° C.

C: less than 190° C. and not less than 170° C.

D: less than 170° C.

The evaluation results are shown in Table 3.

TABLE 3

| | | Transfer Efficiency (%) | | Fixable Temperature (° C.) | |
|---|---|---|---|---|---|
| | Toner | Initial Stage | 100K | Minimum | Maximum |
| Example 1 | a | A | A | A | A |
| Example 2 | b | B | B | A | B |
| Example 3 | c | A | A | B | A |
| Example 4 | d | B | B | A | B |
| Example 5 | e | A | B | B | B |
| Example 6 | f | B | B | A | A |
| Example 7 | g | B | B | A | B |
| Comparative Example 1 | a' | D | D | A | B |
| Comparative Example 2 | b' | D | D | D | B |
| Comparative Example 3 | c' | B | B | D | B |

Additional modifications and variations in accordance with further embodiments of the present invention are possible in light of the above teachings. It is therefore to be understood that within the scope of the appended claims the invention may be practiced other than as specifically described herein.

What is claimed is:

1. A toner, comprising;

a main body particle including a binder resin, the binder resin including an amorphous resin and a crystalline resin;

a layer B located overlying the main body particle, the layer B comprising particles of a resin B; and a layer A located overlying the layer B, the layer A comprising particles of a resin A.

2. The toner according to claim 1, wherein the amorphous resin is an amorphous polyester resin, the crystalline resin is a crystalline polyester resin, the resin A is a styrene-acrylic resin, and the resin B is an acrylic resin.

3. The toner according to claim 2, wherein the styrene-acrylic resin is an uncross-linked resin.

4. The toner according to claim 2, wherein the acrylic resin is a cross-linked resin.

5. A method of manufacturing toner according to claim 1, comprising:

dissolving or dispersing toner components in an organic solvent to prepare a toner components liquid, the toner components including the binder resin;

emulsifying the toner components liquid in an aqueous medium to prepare an emulsion, the aqueous medium containing the particles of the resins A and B;

removing the organic solvent from the emulsion; and heating the emulsion.

6. A method of manufacturing toner according to claim 1, comprising:

dissolving or dispersing toner components in an organic solvent to prepare a toner components liquid, the toner components including the binder resin;

adding the toner components liquid to an aqueous medium, the aqueous medium containing the particles of the resin A;

adding the particles of the resin B to the aqueous medium;

emulsifying the toner components liquid in the aqueous medium to prepare an emulsion;

removing the organic solvent from the emulsion; and heating the emulsion.

7. A method of manufacturing toner according to claim 1, comprising:

dissolving or dispersing toner components in an organic solvent to prepare a toner components liquid, the toner components including the binder resin;

emulsifying the toner components liquid in an aqueous medium to prepare an emulsion, the aqueous medium containing the particles of the resin A;

adding the particles of the resin B to the emulsion;

removing the organic solvent from the emulsion; and heating the emulsion.

8. An image forming method, comprising:

charging an electrophotographic photoreceptor;

forming an electrostatic latent image on the charged electrophotographic photoreceptor;

developing the electrostatic latent image into a toner image with the toner according to claim 1;

primarily transferring the toner image from the electrophotographic photoreceptor onto an intermediate transfer member;

secondarily transferring the toner image from the intermediate transfer member onto a recording medium;

fixing the toner image on the recording medium by application of heat and pressure; and removing residual toner particles remaining on the intermediate transfer member without being transferred onto the recording medium.

9. The image forming method according to claim 8, in the secondarily transferring, the toner image is transferred from the intermediate transfer member onto the recording medium at a linear speed of 100 to 1,000 mm/sec within a time period of 0.5 to 60 msec.

10. An image forming apparatus, comprising:

an electrophotographic photoreceptor;

a charger to charge the electrophotographic photoreceptor;

an irradiator to form an electrostatic latent image on the charged electrophotographic photoreceptor;

a developing device containing the toner according to claim 1, the developing device adapted to develop the electrostatic latent image into a toner image with the toner;

a transfer device to transfer the toner image from the electrophotographic photoreceptor onto a recording medium directly or via an intermediate transfer member;

a fixing device to fix the toner image on the recording medium by application of heat and pressure; and a cleaning device to remove residual toner particles remaining on the electrophotographic photoreceptor or the intermediate transfer member without being transferred onto the recording medium.

11. A process cartridge, detachably attachable to image forming apparatus, comprising:

an electrophotographic photoreceptor to bear an electrostatic latent image; and a developing device containing the toner according to claim 1, the developing device adapted to develop the electrostatic latent image into a toner image with the toner.

* * * * *